US008678381B2

(12) United States Patent
Kim et al.

(10) Patent No.: US 8,678,381 B2
(45) Date of Patent: Mar. 25, 2014

(54) MEDIUM TRANSPORT DEVICE, POST-PROCESSING DEVICE, AND IMAGE FORMING APPARATUS WITH URGING MEMBER THAT SEPARATES SUPPORT PORTION AND STACK PORTION

(75) Inventors: Changyu Kim, Kanagawa (JP); Youju Lee, Kanagawa (JP); Woong Lee, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/553,446

(22) Filed: Jul. 19, 2012

(65) Prior Publication Data

US 2013/0181393 A1 Jul. 18, 2013

(30) Foreign Application Priority Data

Jan. 13, 2012 (JP) ..... 2012-004655

(51) Int. Cl.
*B65H 31/26* (2006.01)

(52) U.S. Cl.
USPC ..... 271/220; 271/171

(58) Field of Classification Search
USPC ..... 271/220, 171
See application file for complete search history.

(56) References Cited

U.S. PATENT DOCUMENTS 5,111,252 A * 5/1992 Hamada et al. ..... 271/171

FOREIGN PATENT DOCUMENTS

| | | | |
|---|---|---|---|
| JP | 07-300270 | A | 11/1995 |
| JP | 08-073105 | A | 3/1996 |
| JP | 2003-089463 | A | 3/2003 |
| JP | 2004-250211 | A | 9/2004 |
| JP | 2005-082402 | A | 3/2005 |
| JP | 2006-069727 | A | 3/2006 |
| JP | 2006-069746 | A | 3/2006 |
| JP | 2006-069749 | A | 3/2006 |
| JP | 2011-088682 | A | 5/2011 |
| JP | 2011-088683 | A | 5/2011 |

* cited by examiner

*Primary Examiner* — Gerald McClain
(74) *Attorney, Agent, or Firm* — Sughrue Mion, PLLC

(57) ABSTRACT

A medium transport device includes a stack portion having a stack surface, a medium being stacked on the stack surface, a guide portion provided at the stack surface, the guide portion extending in a width direction intersecting with a transport direction, the medium being transported in the transport direction, an alignment member supported movably along the guide portion, the alignment member contacting the medium and aligning a position of the medium stacked on the stack surface, and an urging member arranged between the alignment member and the stack portion, the urging member urging the alignment member to the stack surface.

7 Claims, 20 Drawing Sheets

MEDIUM TRANSPORT DEVICE, POST-PROCESSING DEVICE, AND IMAGE FORMING APPARATUS WITH URGING MEMBER THAT SEPARATES SUPPORT PORTION AND STACK PORTION

CROSS-REFERENCE TO RELATED APPLICATIONS

This application is based on and claims priority under 35 USC 119 from Japanese Patent Application No. 2012-004655 filed Jan. 13, 2012.

BACKGROUND

The present invention relates to a medium transport device, a post-processing device, and an image forming apparatus.

SUMMARY

According to an aspect of the invention, there is provided a medium transport device including a stack portion having a stack surface, a medium being stacked on the stack surface; a guide portion provided at the stack surface, the guide portion extending in a width direction intersecting with a transport direction, the medium being transported in the transport direction; an alignment member supported movably along the guide portion, the alignment member contacting the medium and aligning a position of the medium stacked on the stack surface; and an urging member arranged between the alignment member and the stack portion, the urging member urging the alignment member to the stack surface.

BRIEF DESCRIPTION OF THE DRAWINGS

An exemplary embodiment of the present invention will be described in detail based on the following figures, wherein.

DETAILED DESCRIPTION

A specific example of an exemplary embodiment of the present invention (hereinafter, referred to as an exemplary embodiment) is described below with reference to the figures. However, the present invention is not limited thereto.

For easier understanding of the following description, in the figures, it is assumed that the front-rear direction represents the X-axis direction, the left-right direction represents the Y-axis direction, and the up-down direction represents the Z-axis direction, and directions or sides indicated by arrows X, −X, Y, −Y, Z, and −Z respectively represent the forward, rearward, rightward, leftward, upward, and downward directions, or represent the front, rear, right, left, upper, and lower sides.

Also, in the figures, a symbol in which a dot "•" is illustrated in a circle "○" represents an arrow directed from the back side to the front side of the paper, and a symbol in which a cross "x" is illustrated in a circle "○" represents an arrow directed from the front side to the back side of the paper.

In the following description with reference to the figures, illustration of members other than members required for description for easier understanding is occasionally omitted.

First Exemplary Embodiment

Figure 1:
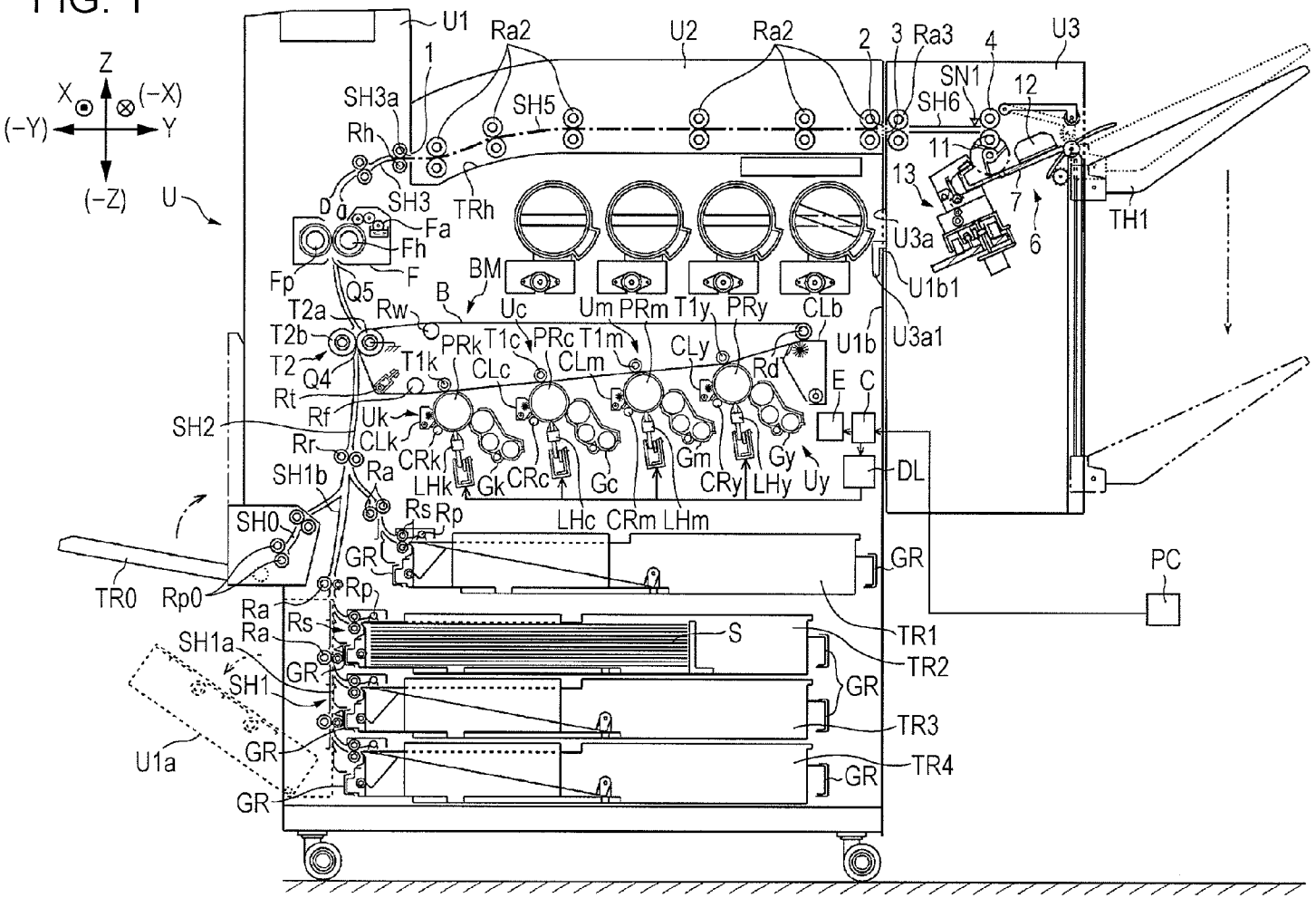
FIG. 1 is an entire explanatory view of an image forming apparatus according to a first exemplary embodiment of the present invention.

FIG. 1 is an entire explanatory view of an image forming apparatus according to a first exemplary embodiment of the present invention.

In FIG. 1, a printer U being an example of the image forming apparatus according to the first exemplary embodiment of the invention includes a printer body U1 being an example of an apparatus body. Image information transmitted from an information processing device PC is input to a controller C. The information processing device PC is an example of a transmitting device of image information and is electrically connected with the printer U. The image information input to the controller C is converted into image information of yellow Y, magenta M, cyan C, and black K for formation of latent images, at a predetermined timing, and is output to a latent-image forming circuit DL.

If a document image is a single-color image, i.e., a monochrome image, image formation of only black K is input to the latent-image forming circuit DL.

The latent-image forming circuit DL has driving circuits (not shown) for the respective colors Y, M, C, and K, and outputs signals corresponding to the input image information to latent-image forming devices LHy, LHm, LHc, and LHk arranged for the respective colors, at a predetermined timing.

Figure 2:
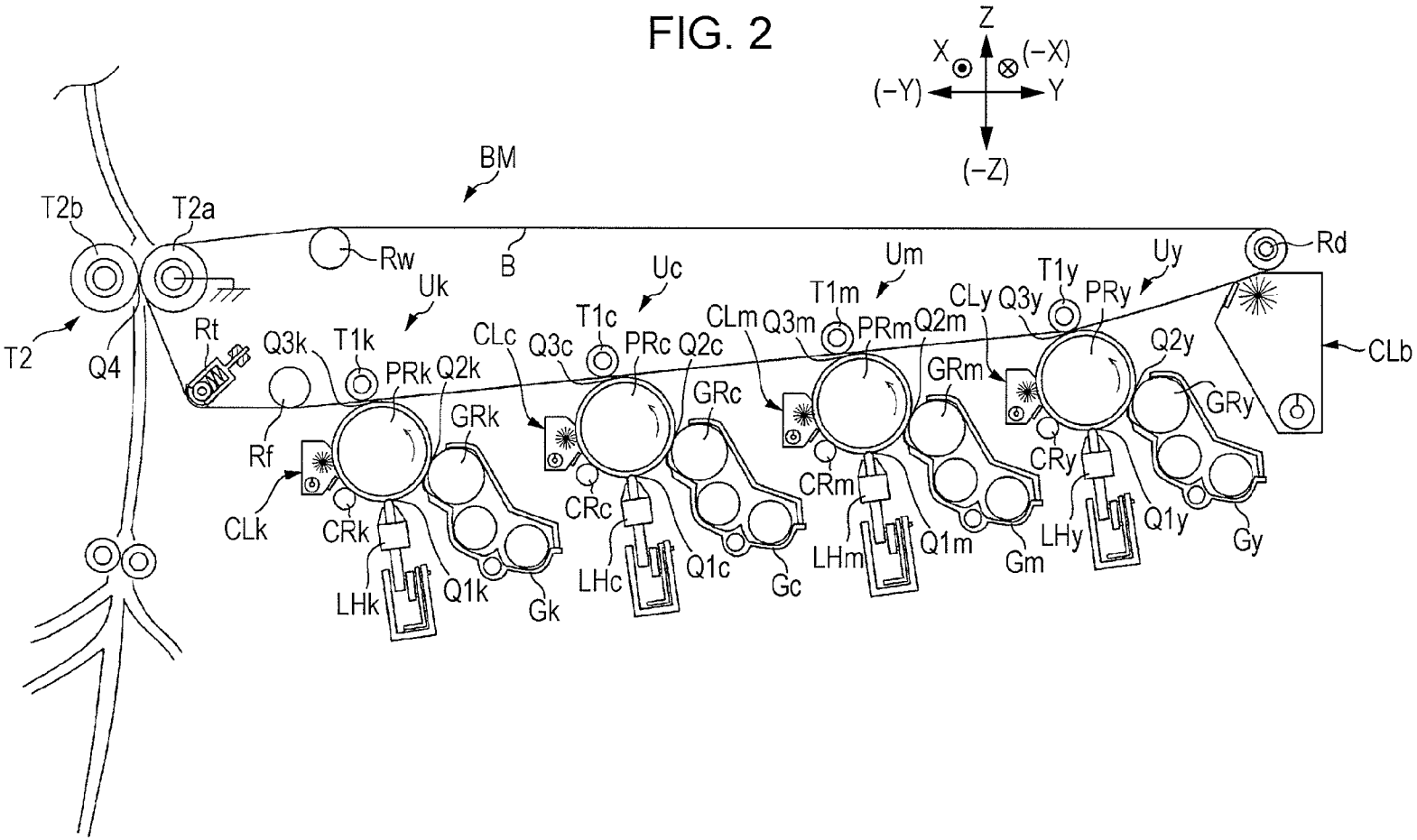
FIG. 2 is an enlarged explanatory view of part of the image forming apparatus according to the first exemplary embodiment of the present invention.

FIG. 2 is an enlarged explanatory view of part of the image forming apparatus according to the first exemplary embodiment of the present invention.

In FIGS. 1 and 2, latent-image write light of Y, M, C, and K emitted from respective latent-image write light sources of the latent-image forming devices LHy to LHk is incident on rotational photoconductors PRy, PRm, PRc, and PRk each being an example of an image holding body. In the first exemplary embodiment, the latent-image forming devices LHy to LHk each are formed of a LED array, in which LEDs each being an example of a light-emitting element are arranged in a line along the width direction of an image.

Charging units CRy, CRm, CRc, and CRk; the latent-image forming devices LHy, LHm, LHc, and LHk; developing devices Gy, Gm, Gc, and Gk; first transfer units T1*y*, T1*m*, T1*c*, and T1*k*; and photoconductor cleaners CLy, CLm, CLc, and CLk each being an example of a cleaner are respectively arranged around the photoconductors PRy, PRm, PRc, and PRk along the rotation direction.

In FIGS. 1 and 2, the photoconductors PRy, PRm, PRc, and PRk are respectively charged by the charging units CRy, CRm, CRc, and CRk. Then, electrostatic latent images are formed on the surfaces of the photoconductors PRy, PRm, PRc, and PRk at image write positions Q1*y*, Q1*m*, Q1*c*, and Q1*k* with the latent-image write light. The electrostatic latent images on the surfaces of the photoconductors PRy, PRm, PRc, and PRk are developed into toner images with developers held on development rollers GRy, GRm, GRc, and GRk of the developing devices Gy, Gm, Gc, and Gk in development regions Q2*y*, Q2*m*, Q2*c*, and Q2*k*. Each of the toner images is an example of a visible image. Each of the development rollers GRy, GRm, GRc, and GRk is an example of a developer holding body.

Then, the developed toner images are transported to first transfer regions Q3*y*, Q3*m*, Q3*c*, and Q3*k* where the toner images contact an intermediate transfer belt B being an example of an intermediate transfer body. A power supply circuit E, which is controlled by the controller C, applies first transfer voltages with a reverse polarity that is reverse to a charging polarity of toners to the first transfer units T1*y*, T1*m*, T1*c*, and T1*k* arranged at the back surface side of the intermediate transfer belt B in the first transfer regions Q3*y*, Q3*m*, Q3*c*, and Q3*k*, at a predetermined timing.

The first transfer units T1*y*, T1*m*, T1*c*, and T1*k* first-transfer the toner images on the photoconductors PRy, PRm, PRc, and PRk, onto the intermediate transfer belt B. The photoconductor cleaners CLy, CLm, CLc, and CLk clean remaining substances and adhering substances on the surfaces of the photoconductors PRy, PRm, PRc, and PRk after first transfer. The charging units CRy, CRm, CRc, and CRk charge again the photoconductors PRy, PRm, PRc, and PRk after cleaning.

The photoconductor PRy, charging unit CRy, latent-image forming device LHy, developing device Gy, first transfer unit T1*y*, and photoconductor cleaner CLy of the Y color form a Y-color visible-image forming device Uy according to the first exemplary embodiment, the visible-image forming unit Uy which forms the toner image being the example of the visible image. Similarly, the photoconductors PRm, PRc, and PRk, charging units CRm, CRc, and CRk, latent-image forming devices LHm, LHc, and LHk, developing devices Gm, Gc, and Gk, first transfer units T1*m*, T1*c*, and T1*k*, and photoconductor cleaners CLm, CLc, and CLk respectively form visible-image forming devices Um, Uc, and Uk of the M-, C-, and K-colors.

A belt module BM being an example of an intermediate transfer device is arranged above the photoconductors PRy to PRk. The belt module BM may move up and down and may be pulled out forward. The belt module BM includes the intermediate transfer belt B, a belt drive roller Rd being an example of a driving member, a tension roller Rt being an example of a tension apply roller, a working roller Rw being an example of an anti-meander roller, an idler roller Rf being an example of a driven member, a backup roller T2*a* being an example of a second transfer facing member, and the first transfer units T1*y*, T1*m*, T1*c*, and T1*k*. The intermediate transfer belt B is rotatably supported by the belt support rollers Rd, Rt, Rw, Rf, and T2*a*.

A second transfer roller T2*b* being an example of a second transfer member is arranged at a position at which the second transfer roller T2*b* faces the backup roller T2*a* with the intermediate transfer belt B interposed therebetween. The backup roller T2*a* and the second transfer roller T2*b* form a second transfer unit T2 according to the first exemplary embodiment. Also, a second transfer region Q4 is formed in a region where the second transfer roller T2*b* contacts the intermediate transfer belt B.

A single-color toner image or multi-color toner images that are successively superposed on the intermediate transfer belt B by the first transfer units T1*y*, T1*m*, T1*c*, and T1*k* in the first transfer regions Q3*y*, Q3*m*, Q3*c*, and Q3*k* are transported to the second transfer region Q4.

The first transfer units T1*y* to T1*k*, the intermediate transfer belt B, the second transfer unit T2, etc., form a transfer device T1+T2+B according to the first exemplary embodiment. Also, the visible-image forming devices Uy to Uk and the transfer device T1+T2+B form an image recording unit Uy to Uk+T1+T2+B according to the first exemplary embodiment.

In FIG. 1, four rows of left and right guide rails GR each being an example of a guide member are provided below the visible-image forming devices Uy to Uk. Paper feed trays TR1 to TR4 each being a paper-feed container are supported by the guide rails GR so that the paper-feed trays TR1 to TR4 may be inserted and removed in the front-rear direction. Recording sheets S each being an example of a medium housed in any of the paper-feed trays TR1 to TR4 are picked up by a pickup roller Rp being an example of a pickup member, and are separated one by one by a separating roller Rs being an example of a separating member. The recording sheet S is transported along a paper-feed path SH1 being an example of a medium transport path by plural transport rollers Ra each being an example of a transport member, and is sent to a registration roller Rr being an example of a medium-transport-timing adjusting member arranged upstream of the second transfer region Q4 in a sheet transport direction.

The pickup roller Rp, the separating roller Rs, etc., form a paper-feed device Rp+Rs according to the first exemplary embodiment.

Also, a manual tray TR0 being an example of a manual paper-feed unit is provided at the left side of the paper-feed tray TR1 arranged at the top row. Recording sheets S supported by the manual tray TR0 are fed by a manual paper-feed roller Rp0 being an example of a manual paper-feed member, transported through a manual transport path SH0, and sent to the registration roller Rr.

The registration roller Rr transports the recording sheet S to a transport path SH2 being an example of a transport path arranged downstream of the paper-feed path SH1, and transports the recording sheet S to the second transfer region Q4, in synchronization with a timing at which the toner images formed on the intermediate transfer belt B is transported to the second transfer region Q4. When the recording sheet S passes through the second transfer region Q4, the backup roller T2*a* is grounded, the power supply circuit E controlled by the controller C applies the second transfer voltages with the reverse polarity that is reverse to the charging polarity of the toners, to the second transfer unit T2*b*, and the toner images on the intermediate transfer belt B are transferred from the intermediate transfer belt B onto the recording sheet S.

A belt cleaner CLb being an example of an intermediate-transfer-body cleaner, cleans the intermediate transfer belt B after the second transfer.

The recording sheet S with the toner images second-transferred thereon is transported to a fixing region Q5 that is a contact region where a heat roller Fh being an example of a heat fixing member of a fixing device F contacts a pressure roller Fp being an example of a pressure fixing member of the fixing device F. The toner images are fixed with heat when the recording sheet S passes through the fixing region Q5. A release-agent apply device Fa applies a release agent to the surface of the heat roller Fh so that the recording sheet S is easily released from the heat roller Fh.

A paper-output path SH3 is arranged above the fixing device F, i.e., is arranged downstream of the fixing device F in the sheet transport direction. The paper-output path SH3 is an example of a transport path through which the recording sheet S is transported toward a paper-output tray TRh being an example of an output-medium stack portion of the printer body U1. Hence, when the recording sheet S is transported toward the paper-output tray TRh, the fixed recording sheet S is transported through the paper-output path SH3, and is output from a sheet output opening SH3*a* being an example of a medium output opening, by a paper-output roller Rh being an example of an output member of the printer body U1.

In FIG. 1, according to the first exemplary embodiment, a lower cover U1*a* being an example of an upstream open member is supported at the left side of the lower three-row paper-feed trays TR2 to TR4, so as to be openable and closable between a normal position indicated by solid lines in FIG. 1 and an open position indicated by broken lines in FIG. 1. The lower cover U1*a* provides guiding at the left side of the paper-feed path SH1 at the left side of the paper-feed trays TR2 to TR4, i.e., provides a guide, and supports the outer sides of a pair of the transport rollers Ra. Hence, when the lower cover U1*a* is moved to the open position, a lower portion of the paper-feed path SH1, i.e., an upstream paper-feed path SH1*a* arranged at an upstream side in the sheet transport direction is open, and a jammed recording sheet S may be removed.

The transport paths SH0 to SH3 form a transport path SH according to the first exemplary embodiment. The transport path SH, the paper-feed device Rp+Rs, the transport rollers Ra, the registration roller Rr, the paper-output roller Rh, etc., form a medium transport system SH+Ra to Rh.

Description for Sheet Transport Unit U2

In FIG. 1, the printer U according to the first exemplary embodiment includes a sheet transport unit U2 being an example of a medium transport unit removably mounted on the paper-output tray TRh. An input opening 1 is provided at one side surface of the sheet transport unit U2. The one side surface is connected with the sheet output opening SH3*a* of the printer body U1. The recording sheet S output by the paper-output roller Rh is transported into the input opening 1. The recording sheet S transported into the input opening 1 is transported through a communication transport path SH5 by communication transport rollers Ra2 each being an example of a medium transport member arranged in the sheet transport unit U2. The recording sheet S transported through the communication transport path SH5 is output from a sheet output opening 2 for a post-processing device. The sheet output opening 2 is formed at another side surface of the sheet transport unit U2.

Description for Post-Processing Device U3

Figure 3:
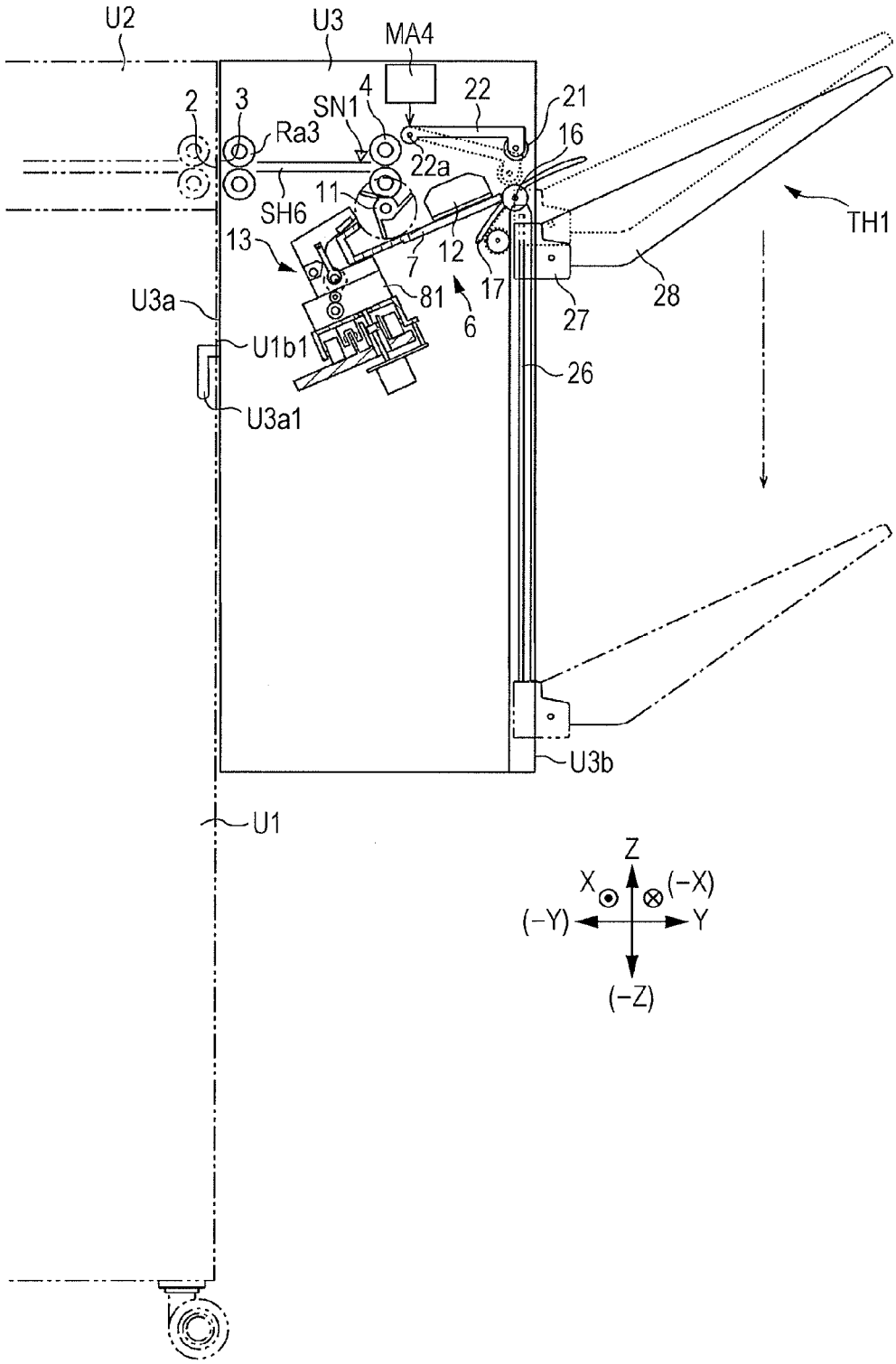
FIG. 3 is an enlarged view of a post-processing device according to the first exemplary embodiment of the present invention, and is particularly an explanatory view showing up-down movement of an output clamp roller.

FIG. 3 is an enlarged view of a post-processing device according to the first exemplary embodiment of the present invention, and is particularly an explanatory view showing up-down movement of an output clamp roller.

Figure 4:
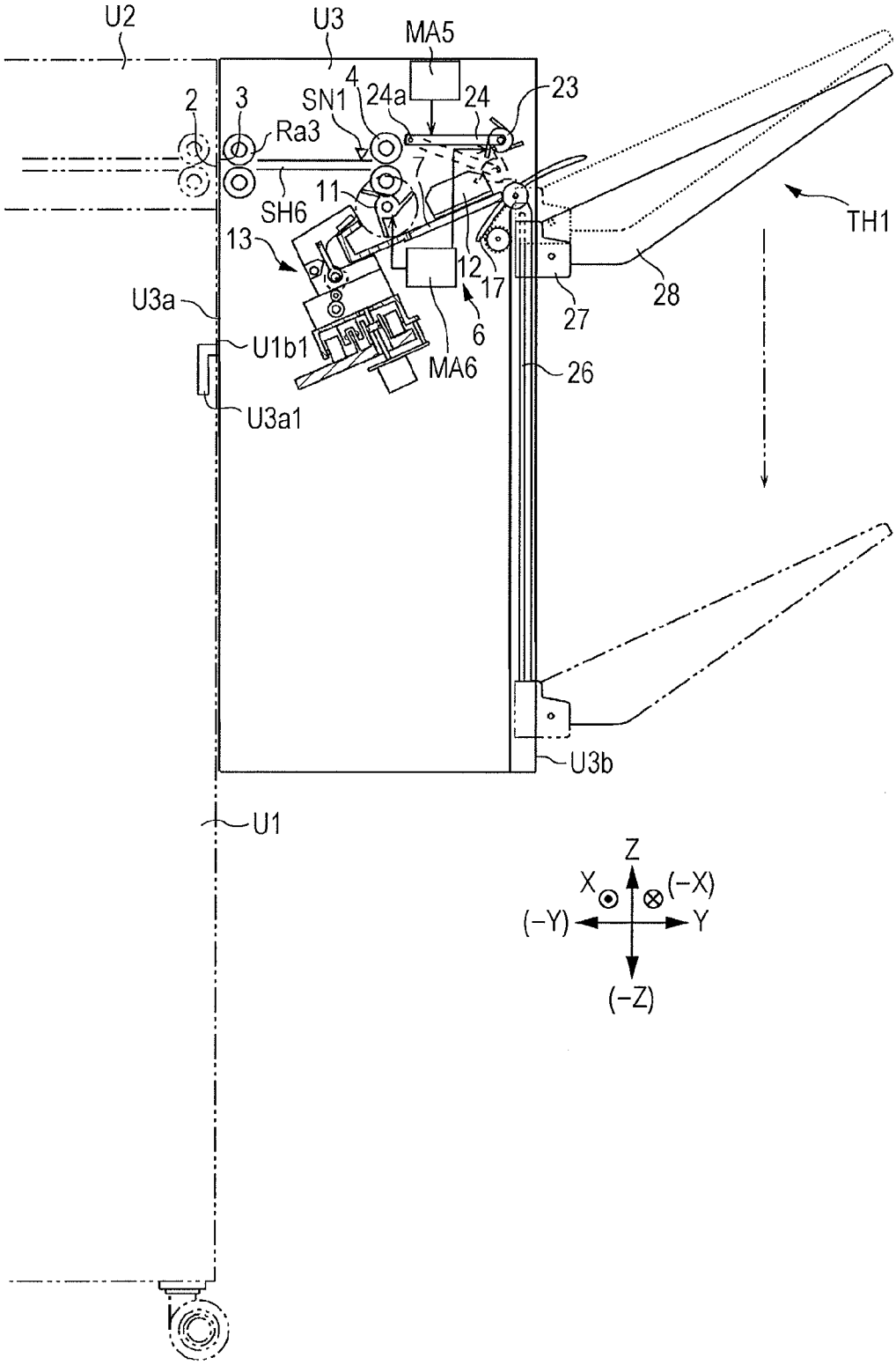
FIG. 4 is an enlarged view of the post-processing device according to the first exemplary embodiment of the present invention, and particularly shows up-down movement of a sub-puddle.

FIG. 4 is an enlarged view of the post-processing device according to the first exemplary embodiment of the present invention, and particularly shows up-down movement of a sub-puddle.

Figure 5:
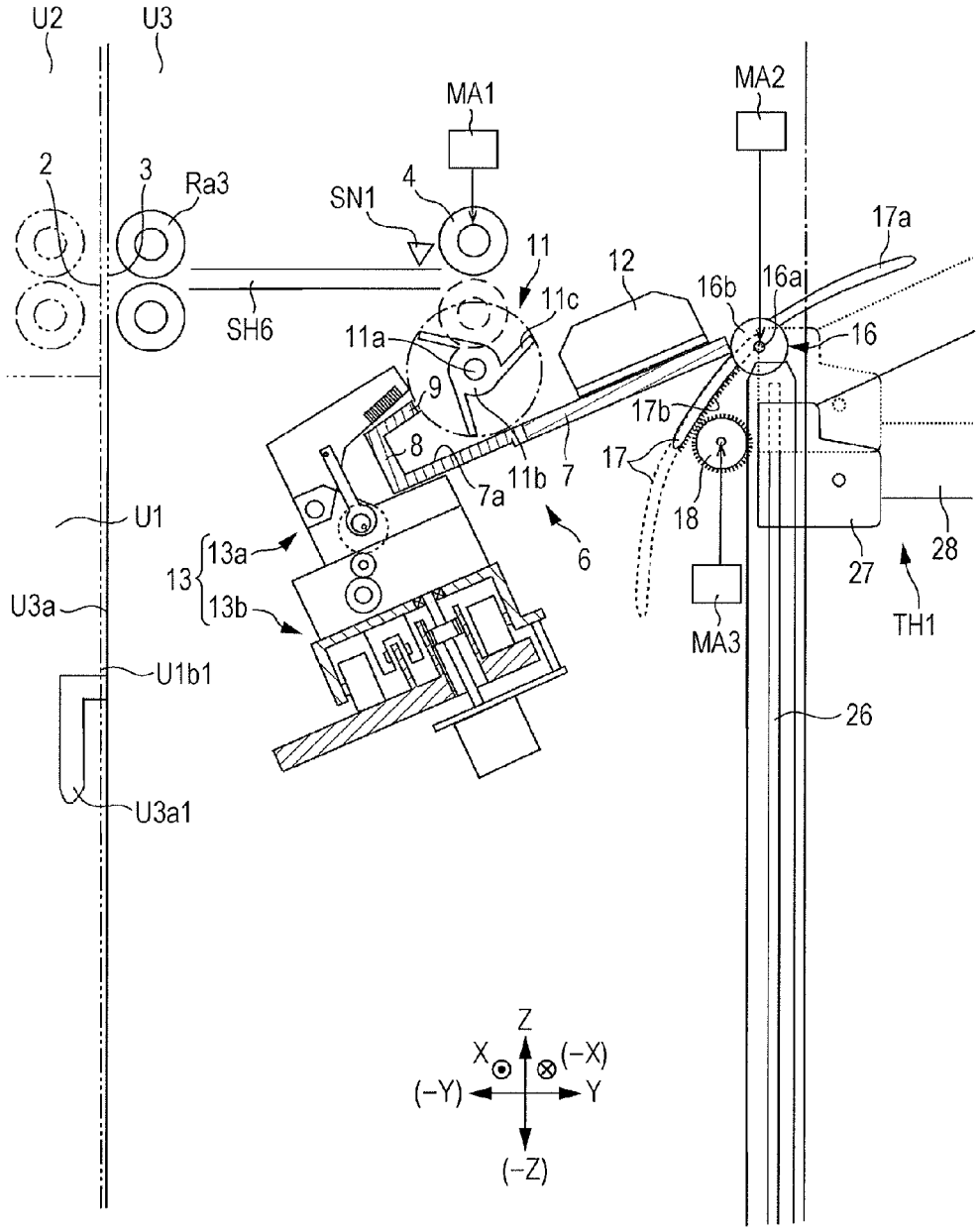
FIG. 5 is an enlarged view of part of the post-processing device according to the first exemplary embodiment of the present invention.

FIG. 5 is an enlarged view of part of the post-processing device according to the first exemplary embodiment of the present invention.

In FIGS. 1, 3, and 4, the printer U according to the first exemplary embodiment includes a post-processing device U3 that is removably supported at a side surface of the printer body U1, is connected with the sheet transport unit U2, and performs post-processing such as aligning and stapling being an example of end binding, for recording sheets S output from the sheet output opening 2.

In FIGS. 1, and 3 to 5, the post-processing device U3 according to the first exemplary embodiment has a left side wall U3*a* being an example of an image-forming-apparatus-body-side wall surface arranged to face a right side wall U1*b* of the printer body U1. A sheet input opening 3 is formed at an upper portion of the left side wall U3*a*. The sheet input opening 3 is an example of a post-processing-device input opening. The sheet input opening 3 is connected with the sheet output opening 2. Also, a pair of front and rear hooks U3*a*1 is formed at a center portion in the up-down direction of the left side wall U3*a*. The hooks U3*a*1 protrude leftward and extend downward. The hooks U3*a*1 are fitted to support holes U1*b*1 formed at the right side wall U1*b* of the printer body U1 and hooked to the printer body U1. Hence, the post-processing device U3 is supported at the printer body U1 and held such that the left side wall U3*a* of the post-processing device U3 extends along the right side wall U1*b* of the printer body U1 and the sheet input opening 3 is connected with the sheet output opening 2 of the sheet transport unit U2.

Accordingly, when a recording sheet S is output from the sheet output opening 2 of the sheet transport unit U2, the sheet S is transported into the sheet input opening 3 of the post-processing device U3.

Description for Compile Output Roller 4

In FIGS. 1 and 5, the recording sheet S transported into the sheet input opening 3 is transported through a post-processing transport path SH6 in the post-processing device U3 by a post-processing input roller Ra3 being an example of a transport member of the post-processing device U3. The post-processing input roller Ra3 is provided downstream of the sheet input opening 3. The recording sheet S transported through the post-processing path SH6 is output to a compile tray 6 being an example of a first stack portion, by a compile output roller 4 being an example of a first output member provided at a downstream end of the post-processing transport path SH6. The compile output roller 4 according to the first exemplary embodiment is rotated and stopped by driving transmitted from a roller drive motor MA1 being an example of a drive source. In the first exemplary embodiment, the roller drive motor MA1 that drives the post-processing input roller Ra3 and the compile output roller 4 uses a stepping motor that rotates by a predetermined angle every time when a pulse signal being an example of a predetermined input signal is input. However, it is not limited thereto. For example, a motor of related art, such as a DC motor, may be used.

A compile output sensor SN1 being an example of a medium detecting member is arranged upstream of the compile output roller 4 at a position near the compile output roller 4. The compile output sensor SN1 detects the recording sheet S in the post-processing transport path SH6.

Description for Compile Tray 6

In FIGS. 1, and 3 to 5, the compile tray 6 includes a compile-tray body 7 being an example of a first-stack-portion body. In FIG. 1, the compile-tray body 7 is inclined with respect to the horizontal line and is arranged such that a right portion is located higher than a left portion.

In FIGS. 3 to 5, an end wall 8 is supported at a left end of the compile-tray body 7. The end wall 8 is an example of an end alignment member in the transport direction. The end wall 8 extends upward. Left ends of recording sheets S, which are output by the compile output roller 4 and stacked on the compile-tray body 7, contact the end wall 8. Thus, left ends of the bundle of recording sheets S are aligned.

A guide wall 9 is formed at an upper end of the end wall 8. The guide wall 9 is an example of a guiding wall. The guide wall 9 is formed such that a gap between the guide wall 9 and a stack surface 7*a* of the compile-tray body 7 becomes wider as the guide wall 9 extends away from the end wall 8. If the left ends of the recording sheets S moving toward the end wall 8, i.e., upstream ends of the recording sheets S in a sheet output direction or a direction in which the recording sheets S are output are curved or curled, the guide wall 9 guides the upstream ends of the recording sheets S to the end wall 8.

Description for Paddle 11

A paddle 11 being an example of a first alignment transport member is rotatably supported at an obliquely upper right side of the guide wall 9. The paddle 11 includes a rotation shaft 11*a* to which driving is transmitted from a paddle drive motor MA6 being an example of a drive source, and plural cylindrical rollers 11*b* each being an example of a rotational body and being arranged along the rotation shaft 11*a* at a predetermined interval. The paddle 11 according to the first exemplary embodiment is driven by a stepping motor similarly to the compile output roller 4.

Three flexible plate-shaped paddle bodies 11*c* are supported on an outer peripheral surface of each roller 11*b* at a predetermined phase interval. The paddle bodies 11*c* each are an example of a transport-member body. Each paddle body 11*c* according to the first exemplary embodiment 1 extends in a tangential direction directed from the outer peripheral surface of the roller 11*b* to the upstream side with respect to the direction in which the recording sheets S move toward the end wall 8, so that the outer end of the paddle body 11*c* is formed to be able to contact the stack surface 7*a* of the compile-tray body 7.

Accordingly, when the paddle 11 rotates, the paddle body 11*c* may contact the top surface of the recording sheets S stacked on the compile tray 6. Thus, the stacked recording sheets S are transported by the paddle 11 to the end wall 8. The left ends of the recording sheets S contact the end wall 8 and are aligned.

Description for Tamper 12

A pair of front and rear tampers 12 is arranged at a right portion of the compile tray 6. The tampers 12 each are an example of a width-direction end alignment member. The tampers 12 contact edges in the width direction of the recording sheets S stacked on the compile tray 6 and align the edges in the width direction of the recording sheets S.

The detailed configuration of the tampers 12 is described later.

Description for Stapler Unit 13

Figure 6:
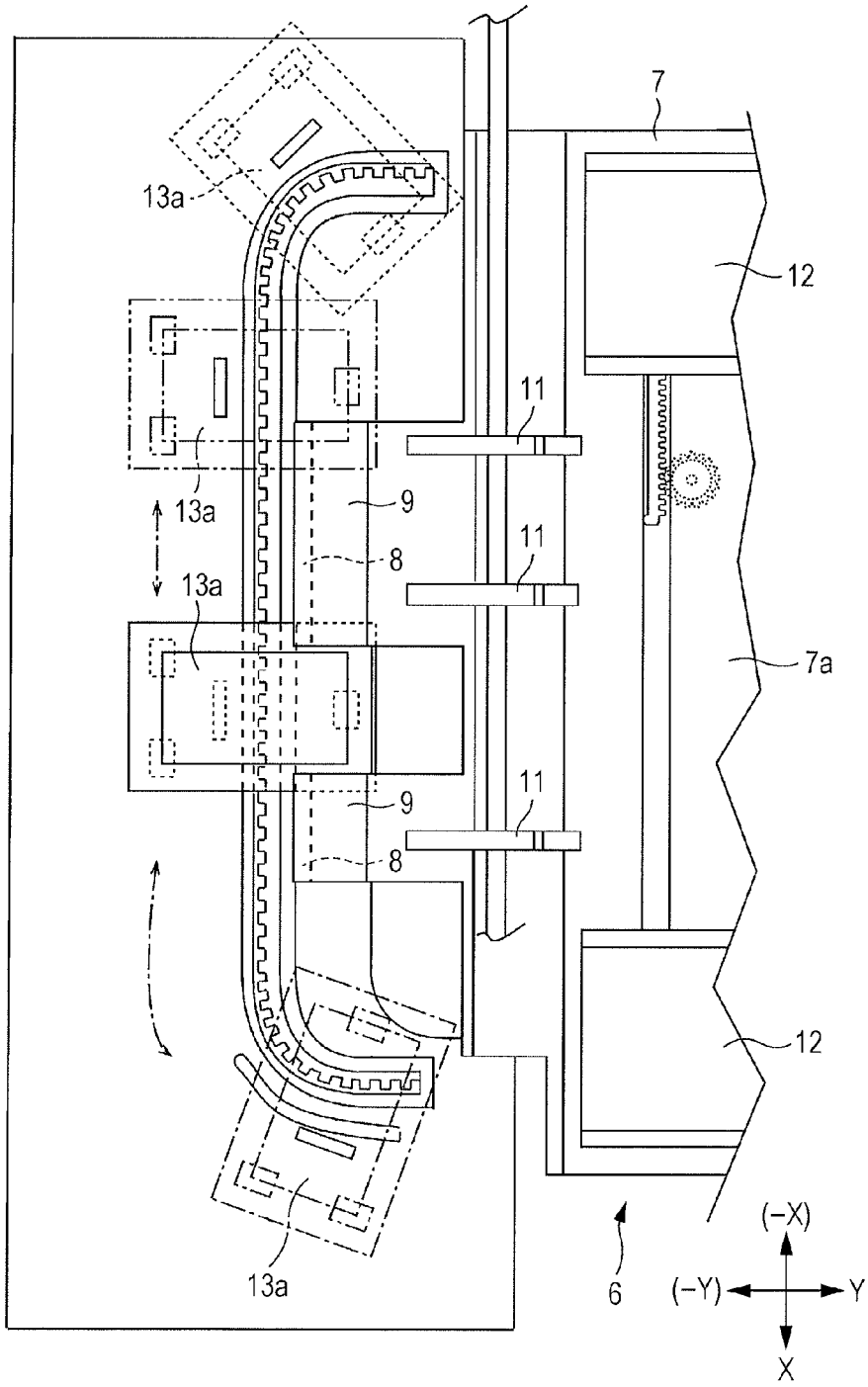
FIG. 6 is an explanatory view of part of a rear end part of a compile tray according to the first exemplary embodiment of the present invention.

FIG. 6 is an explanatory view of part of a rear end part of a compile tray according to the first exemplary embodiment of the present invention.

In FIGS. 3 to 6, a stapler unit 13 being an example of a binding device is provided at an obliquely lower left side of the compile tray 6. The stapler unit 13 has a stapler 13*a* being an example of a binding member. The stapler unit 13 binds the bundle of stacked and aligned recording sheets S on the compile tray 6, with a staple being an example of a binding piece. The stapler 13*a* is supported by a carrier 13*b* being a moving member and being formed movably along the front-rear direction. In FIG. 6, the stapler 13*a* according to the first exemplary embodiment may provide "front-edge corner binding" at a front-edge corner indicated by single-dot chain lines, "side-edge binding" at a front center portion indicated by solid lines or a rear center portion indicated by two-dot chain lines, and "rear-edge corner binding" at a rear-edge corner indicated by broken lines.

Such a stapler unit 13 is a technique of related art, and may employ any of various configurations described in, for example, Japanese Unexamined Patent Application Publication No. 2006-69727, No. 2006-69746, and No. 2006-69749. Hence, the detailed description is omitted.

Description for Stacker Output Roller 16

In FIGS. 3 to 5, a stacker output roller 16 being an example of a second output member is arranged downstream of the compile-tray body 7 in the sheet output direction, i.e., at the right side of the compile-tray body 7. The stacker output roller 16 includes a rotation shaft 16*a* to which driving from a stacker output motor MA2 is transmitted, and a roller body 16*b*. The stacker output motor MA2 is an example of a drive source and is able to rotate in normal and reverse directions. The roller body 16*b* is an example of a rotational part and is supported with a predetermined gap arranged along the rotation shaft 16*a*. The stacker output roller 16 rotates in the normal or reverse direction upon the normal or reverse rotation of the stacker output motor MA2. The stacker output roller 16 according to the first exemplary embodiment is driven by a stepping motor similarly to the compile output roller 4 etc.

Hence, the stacker output roller 16 according to the first exemplary embodiment outputs the recording sheets S, after the recording sheets S are stacked on the compile tray 6 and treated with the post-processing such as aligning or stapling, to a stacker tray TH1 being an example of a second stack portion when the stacker output roller 16 rotates in the normal direction, and the stacker output roller 16 moves the recording sheets S output to the compile tray 6 toward the end wall 8 when the stacker output roller 16 rotates in the reverse direction.

The compile tray 6, the tampers 12, the stacker output roller 16, etc., form a compile tray unit CU being an example of a medium transport device according to the first exemplary embodiment. The detailed configuration of the compile tray unit CU is described later.

Description for Shelf 17

In FIG. 5, a shelf 17 being an example of an extension member is arranged near the stacker output roller 16, at a position between the rotation shaft 16*a* of the stacker output roller 16 and a lower surface of the compile-tray body 7.

The shelf 17 includes a shelf body 17*a* being an example of an extension-part body, the shelf body 17*a* has a plate shape and is curved in an arc form. An arc-shaped rack gear 17*b* being an example of a transmitted portion is formed at a lower surface of the shelf body 17*a*. The rack gear 17*b* is meshed with a shelf drive gear 18 that is arranged below the rotation shaft 16*a* of the stacker output roller 16. The shelf drive gear 18 receives driving from a shelf drive motor MA3 that is an example of a drive source and may rotate in normal and reverse directions. In response to normal and reverse rotation of the motor MA3, the shelf 17 moves between an extending position indicated by solid lines in FIG. 5, at which the shelf 17 may support the lower surface of the recording sheets S, and a housed position indicated by broken lines in FIG. 5, at which the shelf 17 is housed in the post-processing device U3.

The stacker output roller 16 and the shelf 17 are techniques of related art, and may employ any of various configurations described in, for example, Japanese Unexamined Patent Application Publication No. 2006-69746, No. 2006-69749, No. 2011-88682, and No. 2011-88683. Hence, the detailed description is omitted.

Description for Clamp Roller 21

In FIG. 3, a clamp roller 21 being an example of an output driven member and corresponding to the stacker output roller 16 is arranged above the compile-tray body 7. The clamp roller 21 is supported at a distal end part of a clamp arm 22 being an example of an arm member supported rotatably around a rotation shaft 22*a*. The clamp roller 21 is supported movably between an upper position being an example of a separate position indicated by solid lines in FIG. 3, at which the clamp roller 21 is separated from the stacker output roller 16, and a lower position being an example of a contact position indicated by broken lines in FIG. 3, at which the clamp roller 21 comes close to the stacker output roller 16, contact the recording sheets S, and clamps the recording sheets S, in response to the rotation of the clamp arm 22 when driving from a clamp motor MA4 is transmitted to the clamp arm 22.

Description for Sub-Paddle 23

In FIG. 4, a sub-paddle 23 being an example of a second alignment transport member is arranged at a position deviated from the clamp roller 21 in the front-rear direction. According to the first exemplary embodiment, plural sub-paddles 23 are arranged at a predetermined interval in the front-rear direction, and each have a configuration similar to the paddle 11. Hence, the detailed description is omitted. Each sub-paddle 23 is supported at a distal end part of a paddle arm 24 being an example of an arm member supported rotatably around a rotation shaft 24*a*. The sub-paddle 23 is supported movably between a standby position indicated by solid lines in FIG. 4, at which the sub-paddle 23 is raised and separated from the stack surface 7*a* of the compile tray 6, and a take-in position indicated by broken lines in FIG. 4, at which the sub-paddle 23 is lowered and comes close to the stack surface 7*a* of the compile tray 6, and takes in the recording sheets S on the compile tray 6 toward the end wall 8, in response to the rotation of the paddle arm 24 when driving from a paddle-arm motor MA5 is transmitted to the paddle arm 24.

The raising and lowering mechanisms for the clamp roller 21 and the sub-paddle 23, and the driving mechanism for the sub-paddle 23 are techniques of related art, and may employ any of various configurations described in, for example, Japanese Unexamined Patent Application Publication No. 2006-69727, No. 2006-69746, and No. 2006-69749. Hence, the detailed description is omitted. Also, according to the first exemplary embodiment, a drive source for the sub-paddle 23 is common to the paddle drive motor MA6 being the drive source for the paddle 11; however, a drive source for the sub-paddle 23 may be provided independently from the drive source for the paddle 11.

Description for Stacker Tray TH1

In FIGS. 1, and 3 to 5, the stacker tray TH1 is supported at a right side wall U3*b* of the post-processing device U3. The stacker tray TH1 is an example of a second stack portion. The recording sheets S stacked on the compile tray 6 are output to the stacker tray TH1. The stacker tray TH1 includes a tray guide 26 being an example of a lowering and raising guide portion. The tray guide 26 extends in the up-down direction along the right side wall U3*b* of the post-processing device U3. A slider 27 being an example of an output movement portion is supported at the tray guide 26 so that the slider 27 is movable up and down along the tray guide 26. A stacker-tray body 28 being an example of a second-stack-portion body is fixed to and supported by the slider 27.

The stacker tray TH1 is lowered in accordance with the height of the top surface of the bundle of recording sheets S stacked on the upper surface of the stacker-tray body 28. Such a raising and lowering mechanism is a technique of related art, and may employ any of various configurations, such as raising and lowering mechanisms described in, for example, Japanese Unexamined Patent Application Publication No. 7-300270 and No. 2003-089463. Hence, the detailed description is omitted.

Detailed Description for Compile Tray Unit CU

Figure 7:
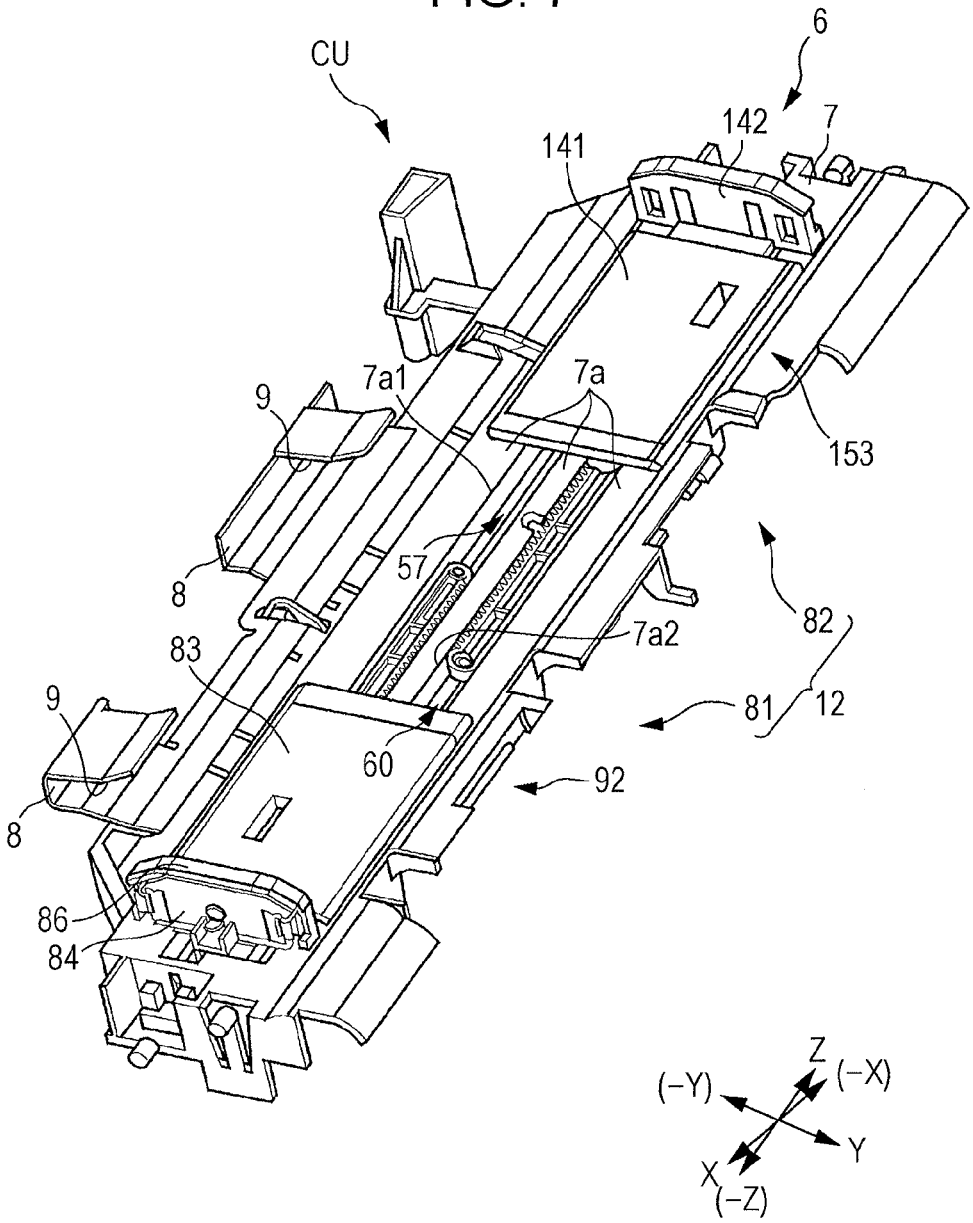
FIG. 7 is a perspective view when a compile tray unit according to the first exemplary embodiment of the present invention is viewed from the upper side.

FIG. 7 is a perspective view when a compile tray unit according to the first exemplary embodiment of the present invention is viewed from the upper side.

Figure 8:
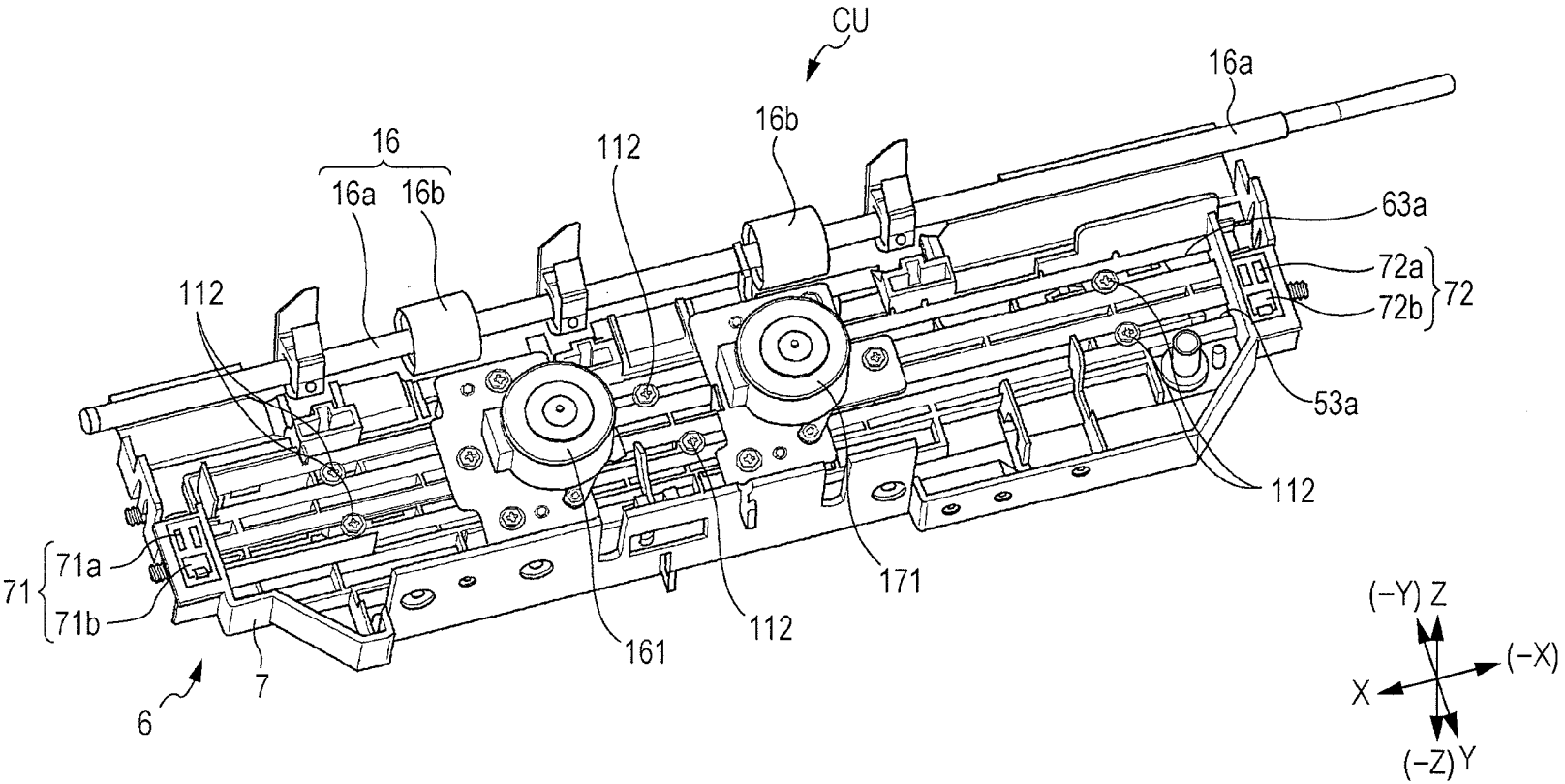
FIG. 8 is a perspective view when the compile tray unit according to the first exemplary embodiment of the present invention is viewed from the lower side.

FIG. 8 is a perspective view when the compile tray unit according to the first exemplary embodiment of the present invention is viewed from the lower side.

In FIGS. 7 and 8, the compile tray unit CU according to the first exemplary embodiment includes the compile tray 6 which is an example of a stack portion and on which recording sheets S are stacked. The compile tray 6 includes the plate-shaped compile-tray body 7 extending in the front-rear direction being an example of a width direction intersecting with a direction in which a recording sheet S is transported. The stack surface 7*a* is formed at the upper portion of the compile-tray body 7. The recording sheets S are stacked on the stack surface 7*a*. The stack surface 7*a* is inclined such that a right portion thereof is higher than a left portion.

The stack surface 7*a* has a pair of a left long hole 7*a*1 and a right long hole 7*a*2 extending in the front-rear direction. The left and right long holes 7*a*1 and 7*a*2 are arranged in parallel to each other with a gap in the sheet transport direction in which a recording sheet S is transported.

Figure 9:
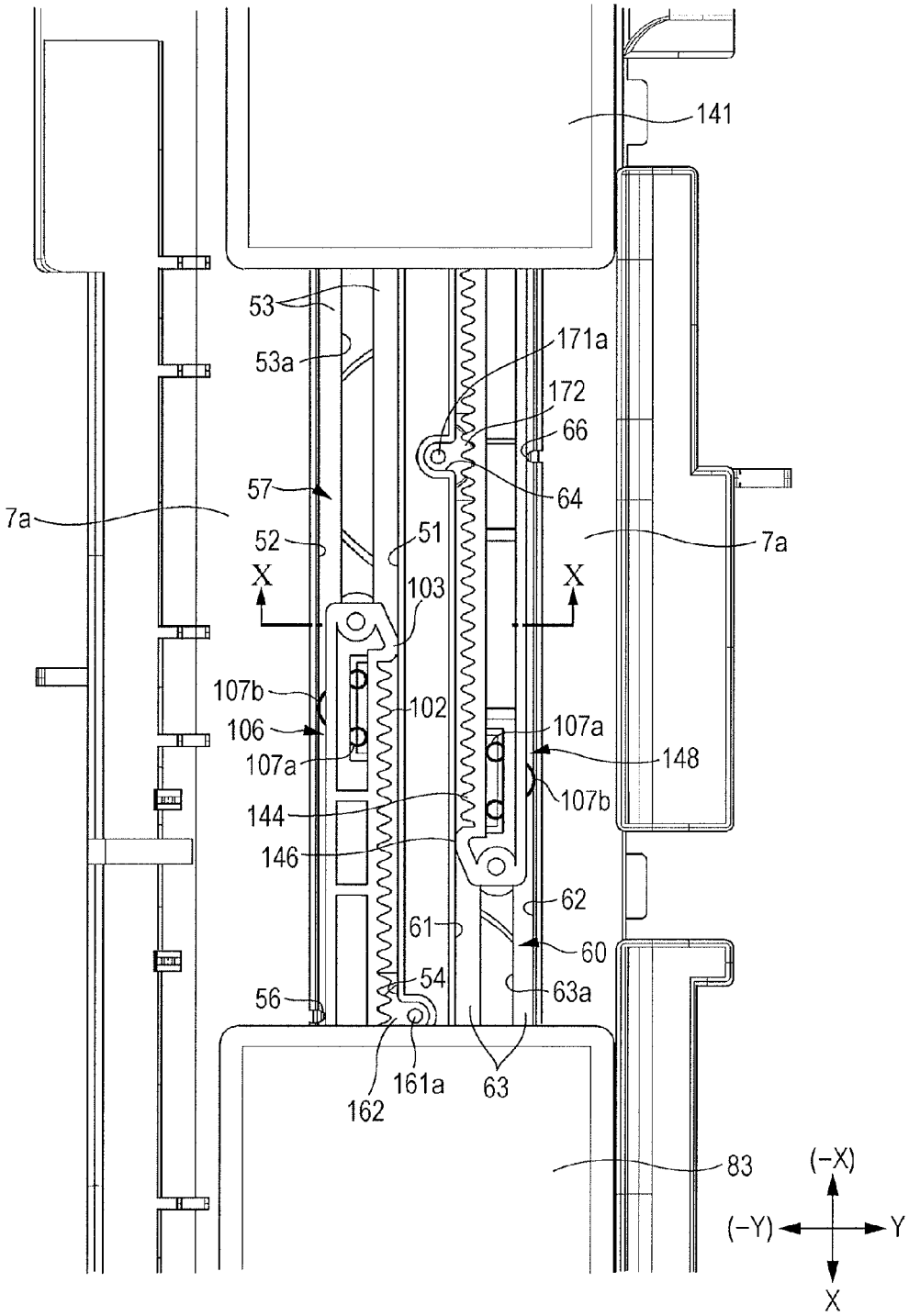
FIG. 9 is an explanatory view of part of the compile tray unit according to the first exemplary embodiment of the present invention when viewed from the upper side.

FIG. 9 is an explanatory view of part of the compile tray unit according to the first exemplary embodiment of the present invention when viewed from the upper side.

Figure 10:
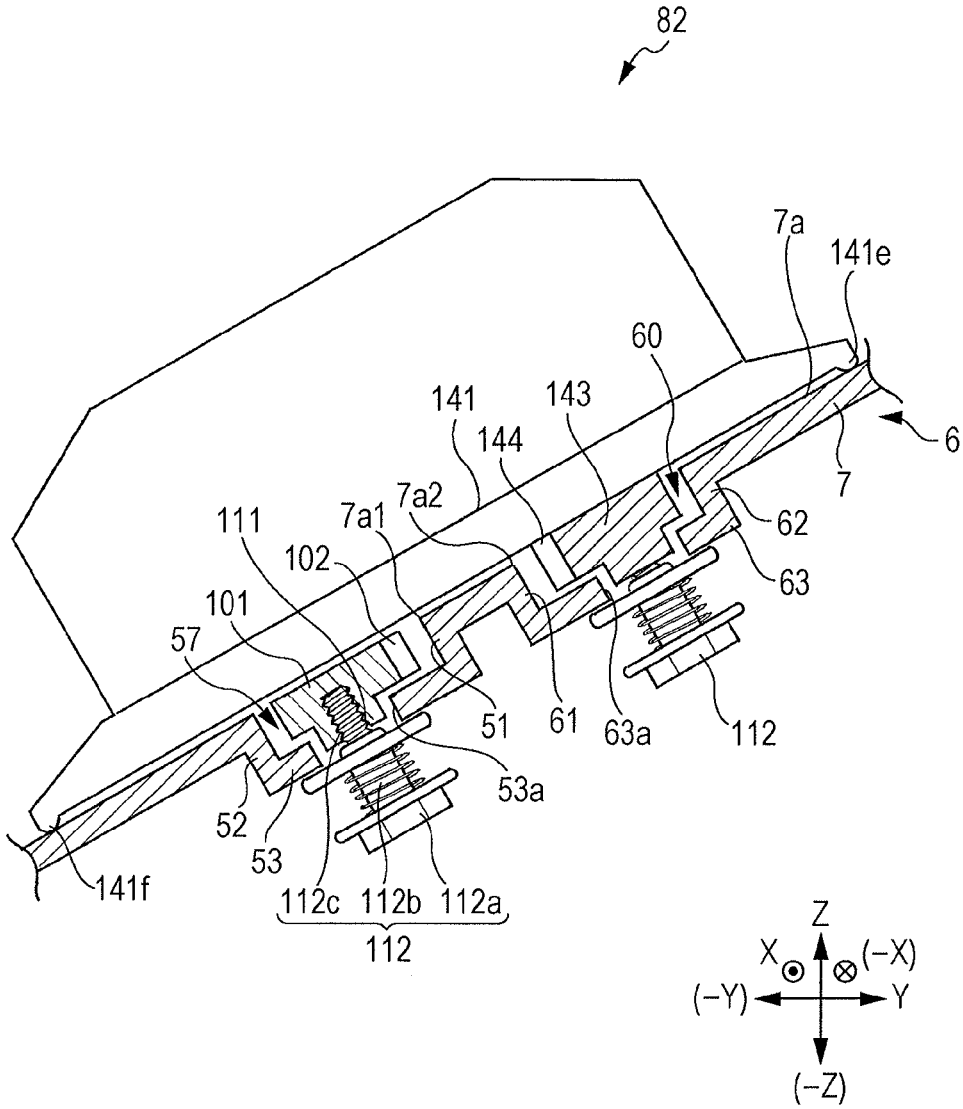
FIG. 10 is a cross-sectional view taken along line X-X in FIG. 9.

FIG. 10 is a cross-sectional view taken along line X-X in FIG. 9.

In FIG. 10, a pair of left and right plate-shaped side walls 51 and 52 is formed at the lower surface of the compile-tray body 7. The side walls 51 and 52 extend from left and right edges of the left long hole 7*a*1 to an obliquely lower right side in a direction perpendicular to the stack surface 7*a*, the direction which is an example of a direction intersecting with the stack surface 7*a*. A plate-shaped bottom portion 53 is supported between the lower edge of the right side wall 51 and the lower edge of the left side wall 52. The bottom portion 53 extends in the front-rear direction. A penetrating portion 53*a* is formed at the bottom portion 53. The penetrating portion 53*a* extends along the bottom portion 53 and penetrates through the bottom portion 53 in the thickness direction.

In FIG. 9, the right side wall 51 and the bottom portion 53 have a pinion opening 54 at the front side with respect to a center portion in the front-rear direction. The pinion opening 54 is an example of an arrangement portion for a transmission member.

Also, the left side wall 52 has a protrusion 56 at a position to face the pinion opening 54. The protrusion 56 is an example of a positioning portion for a transmitted portion. The protrusion 56 protrudes from the left side wall 52 toward the pinion opening 54.

In FIG. 10, a first guide groove 57 being an example of a first guide portion according to the first exemplary embodiment is formed by a space that is surrounded by the side walls 51 and 52, and the bottom portion 53, and is open to the upper side through the left long hole 7*a*1. Hence, the first guide groove 57 according to the first exemplary embodiment has a groove shape penetrating through the compile-tray body 7 in the direction perpendicular to the stack surface 7*a* and extending in the front-rear direction.

In FIGS. 7 to 10, the compile-tray body 7 has a second guide groove 60 being an example of a second guide portion. The second guide groove 60 is arranged in parallel to the first guide groove 57 with a gap provided at the downstream side in the sheet transport direction. To be more specific, the compile-tray body 7 has side walls 61 and 62, a bottom portion 63, a penetrating portion 63*a*, a pinion opening 64, and a protrusion 66 at the right long hole 7*a*2 to respectively correspond to the side walls 51 and 52, the bottom portion 53, the penetrating portion 53*a*, the pinion opening 54, and the protrusion 56. The second guide groove 60 according to the first exemplary embodiment is formed by a space that is surrounded by the side walls 61 and 62, and the bottom portion 63, and is open to the upper side through the right long hole 72*a*2.

The second guide groove 60 and the respective members 61 to 66 forming the second guide groove 60 are formed similarly to the first guide groove 57 and the respective members 51 to 56 forming the first guide groove 57 except that the second guide groove 60 and the respective members 61 to 66 are point-symmetric to the first guide groove 57 and the respective members 51 to 56. Hence, the detailed description for the second guide groove 60 and the respective members 61 to 66 forming the second guide groove 60 is omitted.

The first guide groove 57 and the second guide groove 60 form a guide groove 57+60 being an example of a guide portion according to the first exemplary embodiment.

In FIG. 8, a front sensor 71 being an example of a first detection member is arranged at one end part in the width direction of the first guide groove 57, i.e., at a front end part according to the first exemplary embodiment. The front sensor 71 is formed of an optical sensor including a light-emitting portion 71*a* that emits light, and a light-receiving portion 71*b* that receives the light emitted by the light-emitting portion 71*a*. The light-emitting portion 71*a* and the light-receiving portion 71*b* are arranged to face each other with a gap provided in a groove-width direction of the first guide groove 57. When a member that blocks the light enters an area between the light-emitting portion 71*a* and the light-receiving portion 71*b*, the presence of the member that blocks the light is detected.

Also, a rear sensor 72 being an example of a second detection member is arranged at another end part in the width direction of the first guide groove 57, i.e., at a rear end part according to the first exemplary embodiment. The rear sensor 72 includes a light-emitting portion 72*a* and a light-receiving portion 72*b* and is formed similarly to the front sensor 71 except that the rear sensor 72 is front-and-rear-symmetric to the front sensor 71. Hence, the detailed description of the rear sensor 72 is omitted.

Description for Tamper 12

Figure 11A:
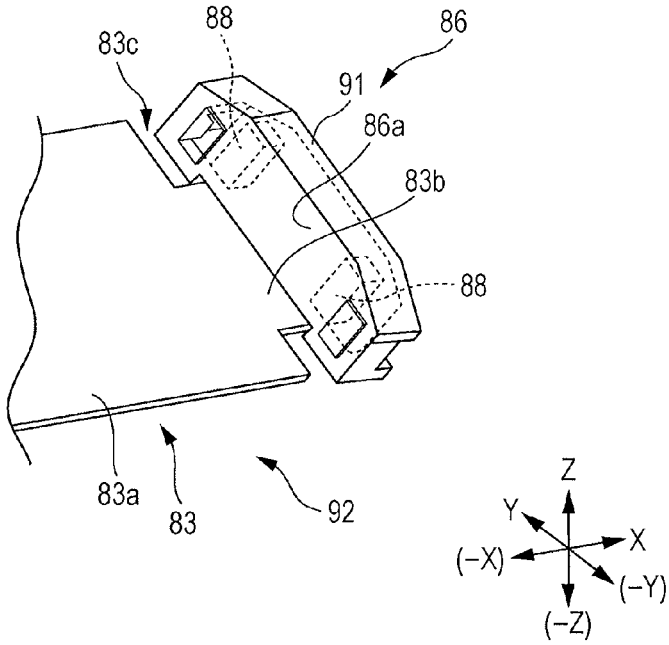
FIGS. 11A and 11B are explanatory views of a front tamper according to the first exemplary embodiment of the present invention, FIG. 11A being a perspective view of part of the front tamper, FIG. 11B being an exploded perspective view of the front tamper.
Figure 11B:
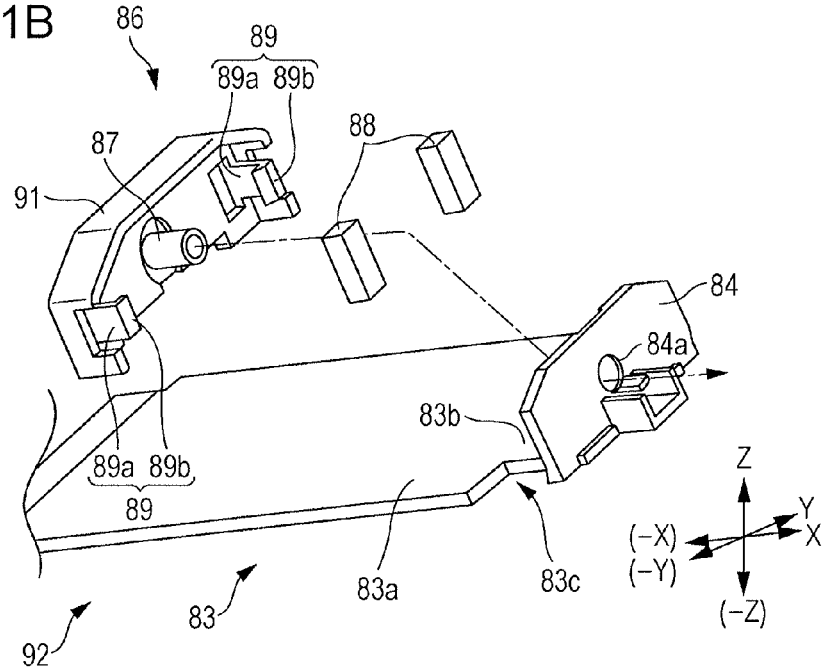

FIGS. 11A and 11B are explanatory views of a front tamper according to the first exemplary embodiment of the present invention, FIG. 11A being a perspective view of part of the front tamper, FIG. 11B being an exploded perspective view of the front tamper.

In FIG. 7, the tampers 12 each being an example of an alignment member are supported at the compile tray unit CU so that the tampers 12 are movable along the guide groove 57+60.

The pair of tampers 12 according to the first exemplary embodiment is arranged in the width direction. The tampers 12 include a front tamper 81 being an example of a first alignment portion that aligns positions of one-side edges in the width direction of the recording sheets S stacked on the stack surface 7*a*, and a rear tamper 82 being an example of a second alignment portion that aligns positions of another-side edges in the width direction of the recording sheets S stacked on the stack surface 7*a*.

Description for Front Tamper 81

In FIGS. 7, 11A, and 11B, the front tamper 81 has a flat-plate-shaped stack plate 83 having an upper surface along the stack surface 7*a* and arranged movably along the stack surface 7*a*. The stack plate 83 includes a stack-plate body 83*a* and an extension portion 83*b* that is supported at the front side of the stack-plate body 83*a* and that has a smaller length in the sheet transport direction than the stack-plate body 83*a*. Hence, a front end part of the stack plate 83 has a shape with both sides in the sheet transport direction being notched. The notch shape forms housing portions 83*c* for a contact portion. In FIG. 11B, the extension portion 83*b* of the stack plate 83 has a support wall 84 that is formed in a standing wall shape with respect to the extension portion 83*b*.

The support wall 84 extends in the sheet transport direction and protrudes to positions above the housing portions 83*c* of the contact portion. A circular guide hole 84*a* penetrating in the front-rear direction is formed at a center portion in the sheet transport direction of the support wall 84.

Description for Front Contact Portion 86

In FIGS. 11A and 11B, a front contact portion 86 being an example of one contact portion is supported at the support wall 84. The front contact portion 86 has a plate shape that is slightly larger than the support wall 84. In FIG. 11A, a contact surface 86*a* is formed at a rear surface of the front contact portion 86. The contact surface 86*a* may contact the one-side edges in the width direction of the recording sheets S, i.e., the front edges of the recording sheets S. Both end parts in the sheet transport direction of the contact surface 86*a* protrude to the lower side, and may be housed in the housing portions 83*c* of the contact portion. If recording sheets S stacked on the stack plate 83 are too thin and hence part of the contact surface 86*a* located above the extension portion 83*b* hardly contacts the recording sheets S, both end parts in the sheet transport direction of the contact surface 86*a* contact the front edges of the recording sheets S.

In FIG. 11B, a cylindrical guided tube 87 is supported at a center portion of the front surface of the front contact portion 86. The guided tube 87 extends forward in correspondence with the guide hole 84*a* of the support wall 84. A pair of urethane foams 88 each being an example of a cushion is supported at both sides in the sheet transport direction of the guided tube 87. The urethane foams 88 according to the first exemplary embodiment each are formed in a prism shape and arranged to extend in a direction perpendicular to the stack plate 83.

Snap fit portions 89 are supported at the outside in the sheet transport direction of the urethane foams 88. The snap fit portions 89 each are an example of a stopper and protrudes forward. Each snap fit portions 89 includes a support part 89*a* extending forward, and a hook claw 89*b* that is supported at the front end of the support part 89*a*, protrudes to the inside in the sheet transport direction, and may be hooked to the front surface of the support wall 84.

A cover portion 91 is formed at an upper edge of the front contact portion 86. The cover portion 91 protrudes forward, covers the upper edge of the support wall 84, and is guided by the upper edge of the support wall 84.

In FIGS. 7, 11A, and 11*b*, if the front contact portion 86 is supported by the support wall 84, the guided tube 87 is inserted into the guide hole 84*a* in a state in which the urethane foams 88 are arranged between the front contact portion 86 and the support wall 84, and the hook claws 89*b* of the snap fit portions 89 are hooked to both end parts in the sheet transport direction of the support wall 84.

Accordingly, the front contact portion 86 is supported movably between a normal position at which the urethane foams 88 are elastically recovered and the hook claws 89*b* contact the front surface of the support wall 84, and a separate position at which the front contact portion 86 moves to the front side with respect to the normal position, the urethane foams 88 are elastically deformed, and the hook claws 89*b* are separated from the support wall 84 to the front side.

If the front contact portion 86 contacts the front edges of the recording sheets S when the positions of the recording sheets S on the stack plate 83 are aligned, the front contact portion 86 pushes the recording sheets S rearward and a reactive force from the recording sheets S pushes and moves the front contact portion 86 forward. In other words, when the front contact portion 86 contacts the recording sheets S, the urethane foams 88 are elastically deformed and absorb a shock generated when the front contact portion 86 contacts the recording sheets S. Accordingly, damage on the front edges of the recording sheets S is reduced, and a noise such as impact sound at the contact is reduced.

When the front contact portion 86 moves between the normal position and the separate position, the guided tube 87, the support part 89*a* of the snap fit portion 89, and the cover portion 91 are guided by the support wall 84. The front contact portion 86 is easily moved while the posture of the front contact portion 86 is held. Accordingly, the front contact portion 86 hardly rattles and is stably moved.

The stack plate 83, the support wall 84, the front contact portion 86, the guided tube 87, the urethane foams 88, the snap fit portions 89, and the cover portion 91 form a front-tamper body 92 being an example of a first alignment-portion body according to the first exemplary embodiment.

Description for Guided Rod 101

Figure 12:
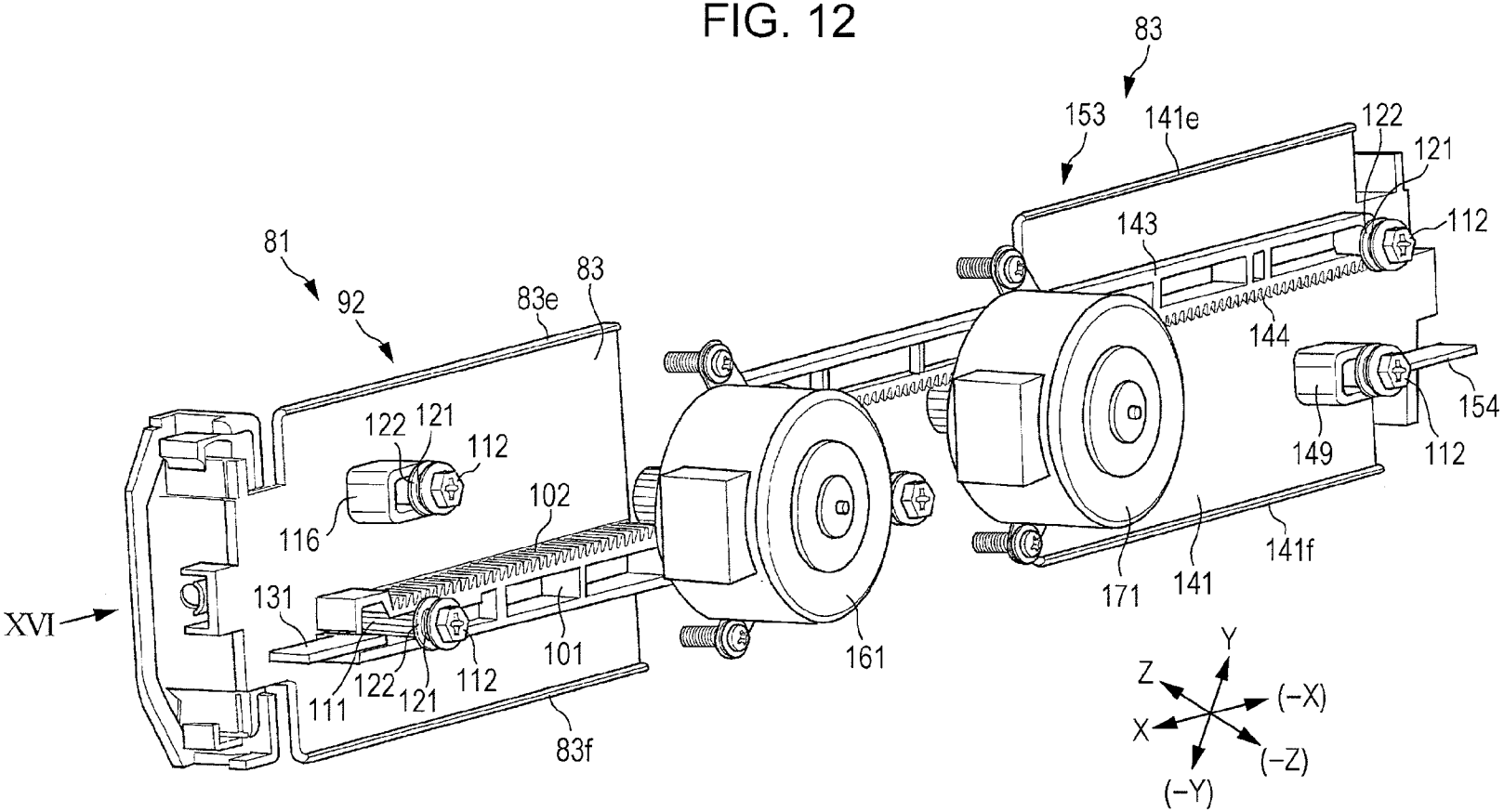
FIG. 12 is a perspective view when a tamper and a tamper motor according to the first exemplary embodiment of the present invention are viewed from the lower side.

FIG. 12 is a perspective view when a tamper and a tamper motor according to the first exemplary embodiment of the present invention are viewed from the lower side.

Figure 13:
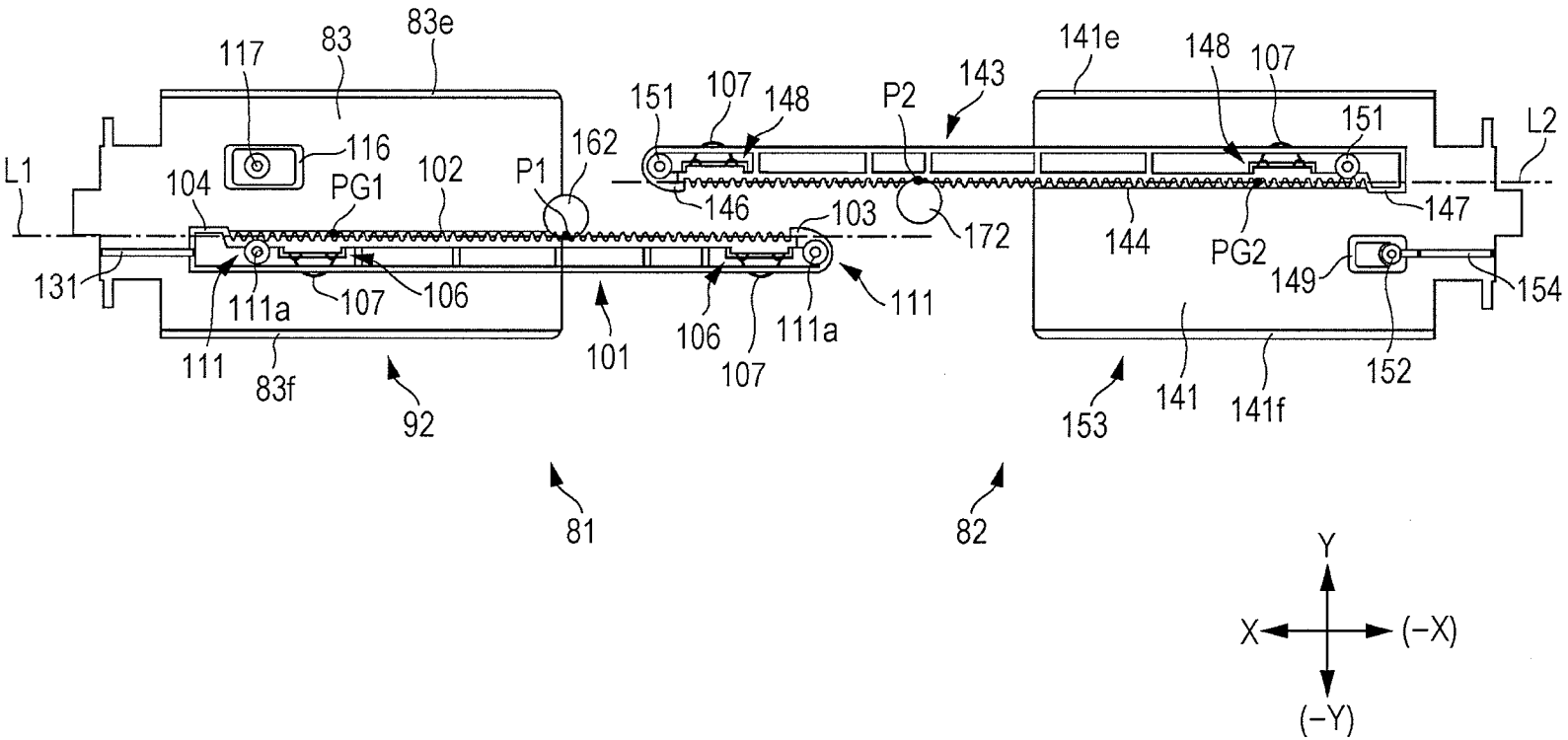
FIG. 13 is an explanatory view when the tamper according to the first exemplary embodiment of the present invention is viewed from the lower side.

FIG. 13 is an explanatory view when the tamper according to the first exemplary embodiment of the present invention is viewed from the lower side.

In FIGS. 12 and 13, a guided rod 101 being an example of one guided portion is arranged at the front-tamper body 92. The guided rod 101 is supported at the lower surface of the stack plate 83, and extends along the first guide groove 57. The guided rod 101 is guided movably along the first guide groove 57 in a state in which the guided rod 101 is fitted to the first guide groove 57.

A rack tooth 102 being an example of a transmitted portion is formed at a right surface of the guided rod 101. The rack tooth 102 is arranged in correspondence with the gravity-center position of the front tamper 81. A pair of front and rear contact portions 103 and 104 is formed at both front and rear ends of the rack tooth 102. The contact portions 103 and 104 protrude to the right side with respect to the rack tooth 102. The contact portions 103 and 104 contact the right side wall 51 of the first guide groove 57, and is guided by the right side wall 51.

Description for Spring Holder 106 and Wire Spring 107

Figure 14A:
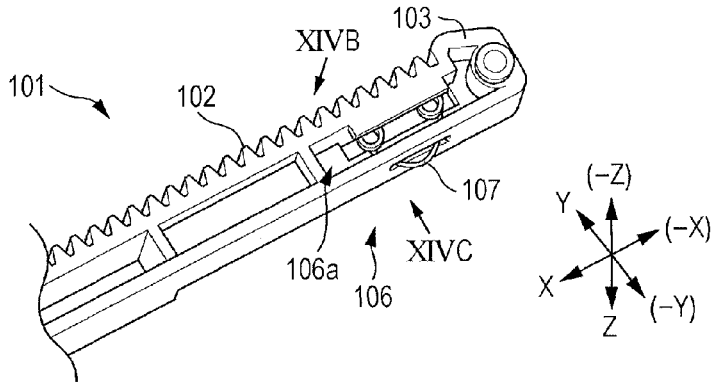
FIGS. 14A to 14D are explanatory views of a spring holder and a wire spring according to the first exemplary embodiment of the present invention, FIG. 14A being a perspective view showing part of the front tamper when viewed from the lower side, FIG. 14B being an illustration viewed along arrow XIVB in FIG. 14A, FIG. 14C being an illustration when viewed along arrow XIVC in FIG. 14A, FIG. 14D being a cross-sectional view taken along line XIVD-XIVD in FIG. 14C.
Figure 14B:
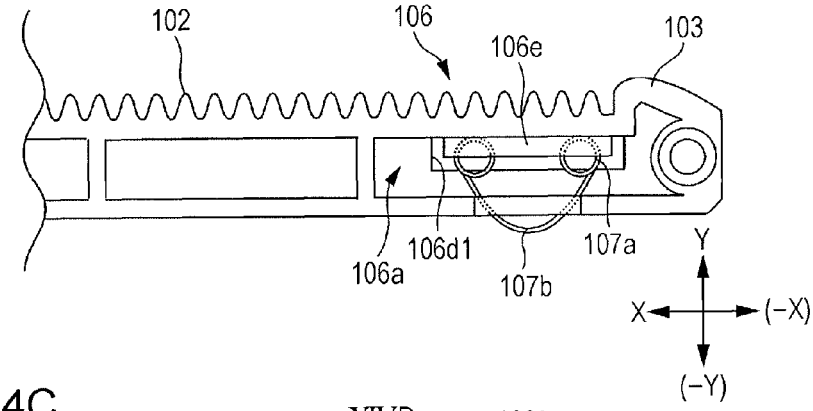
Figure 14C:
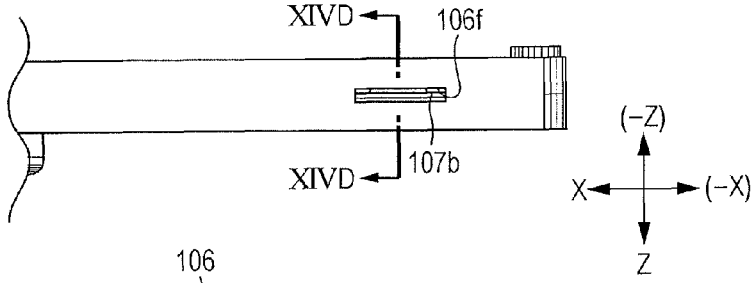
Figure 14D:
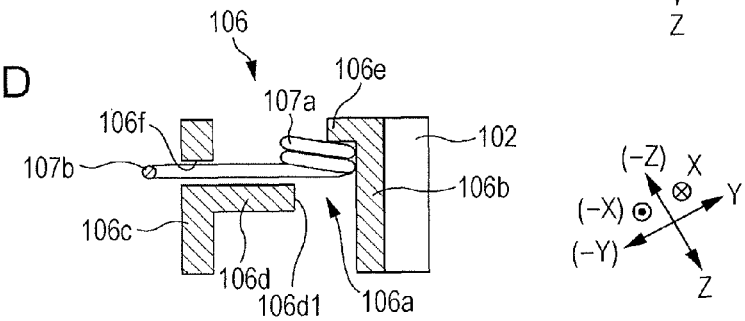

FIGS. 14A to 14D are explanatory views of a spring holder and a wire spring according to the first exemplary embodiment of the present invention, FIG. 14A being a perspective view showing part of the front tamper when viewed from the lower side, FIG. 14B being an illustration viewed along arrow XIVB in FIG. 14A, FIG. 14C being an illustration when viewed along arrow XIVC in FIG. 14A, FIG. 14D being a cross-sectional view taken along line XIVD-XIVD in FIG. 14C.

In FIGS. 13, and 14A to 14D, a pair of front and rear spring holders 106 each being an example of a holder is formed respectively at the contact portions 103 and 104 of the guided rod 101.

In FIGS. 14A to 14D, each spring holder 106 has a housing space 106*a* formed inside the spring holder 106 and extending along the guided rod 101. In FIG. 14D, a right wall 106*b* and a left wall 106*c* extending to a lower right side are formed at the left and right of the housing space 106*a*. An upper bottom wall 106*d* is supported between the right wall 106*b* and the left wall 106*c*. The upper bottom wall 106*d* is a raised bottom. An opening 106*d*1 is formed between the upper bottom wall 106*d* and the right wall 106*b*. The opening 106*d*1 extends along the guided rod 101.

In FIGS. 14A to 14D, a support claw 106*e* is supported at a lower end of the right wall 106*b*. The support claw 106*e* faces the opening 106*d*1 and protrudes from the lower end of the right wall 106*b* toward the left wall 106*c*.

A space surrounded by the right wall 106*b*, the left wall 106*c*, the upper bottom wall 106*d*, and the support claw 106*e* forms the housing space 106*a* according to the first exemplary embodiment.

Also, a slit 106*f* is formed at the left wall 106*c*. The slit 106*f* extends in the front-rear direction and penetrates through the left wall 106*c* in the thickness direction. Hence, the housing space 106*a* is connected with the outside through the slit 106*f*.

The housing space 106*a* and the slit 106*f* form the spring holder 106 according to the first exemplary embodiment.

In FIGS. 14A to 14D, the spring holder 106 supports a wire spring 107 being an example of an urging member and being formed of an elastic wire member.

The wire spring 107 has a pair of ring parts 107*a* each being an example of a held portion. The ring parts 107*a* are arranged in the front-rear direction and formed by bending the wire members into ring shapes. The ring parts 107*a* have ring shapes in which the wire members are wound plural times. Each ring part 107*a* has a larger thickness than the width of the slit 106*f*. A body part 107*b* being an example of a protrusion connects the front and rear ring parts 107*a* with each other. The body part 107*b* has a shape in which the wire member extending in the front-rear direction is curved to protrude to an obliquely lower left side.

Figure 15A:
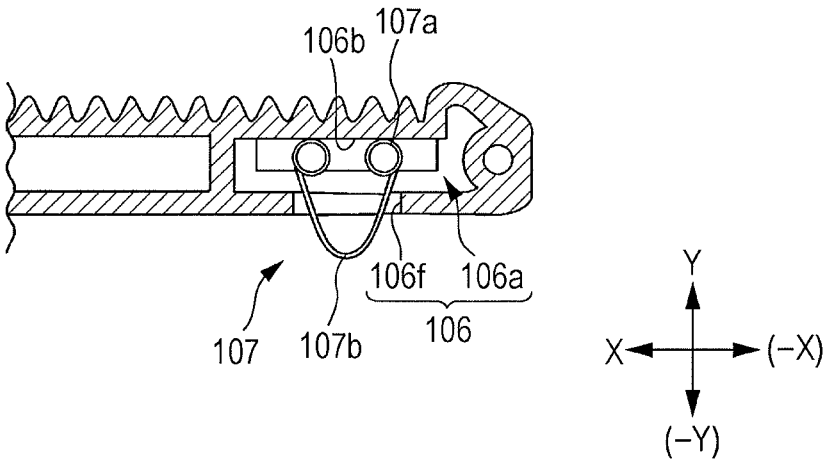
FIGS. 15A and 15B are explanatory views of the wire spring held by the spring holder according to the first exemplary embodiment of the present invention, FIG. 15A being an explanatory view before a guided rod is fitted to a first guide groove, FIG. 15B being an explanatory view after the guided rod is fitted to the first guide groove.
Figure 15B:
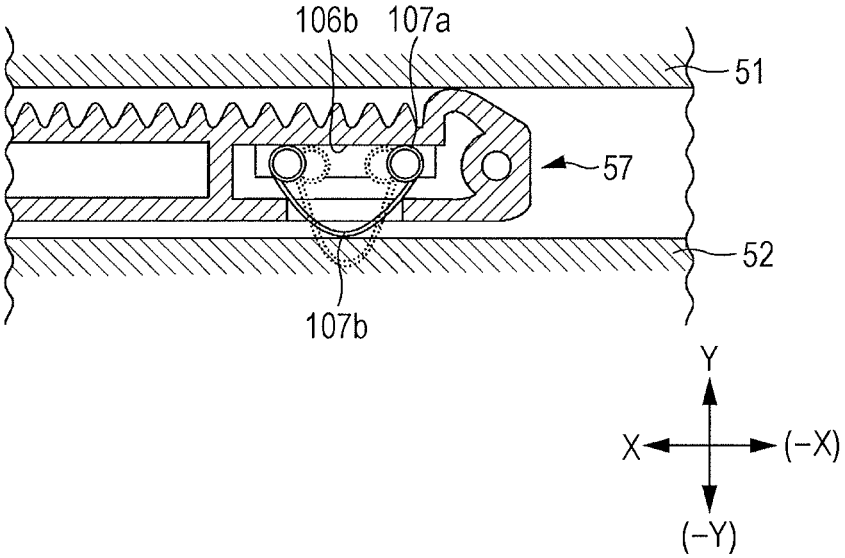

FIGS. 15A and 15B are explanatory views of the wire spring held by the spring holder according to the first exemplary embodiment of the present invention, FIG. 15A being an explanatory view before a guided rod is fitted to a first guide groove, FIG. 15B being an explanatory view after the guided rod is fitted to the first guide groove.

As shown in FIG. 15A, the wire spring 107 is mounted at the spring holder 106 such that the body part 107*b* protrudes from the housing space 106*a* to the outside through the slit 106*f*, and the ring parts 107*a* are housed in the housing space 106*a* while being arranged between the upper bottom wall 106*d* and the support claw 106*e*.

As shown in FIG. 15B, the guided rod 101 is fitted to the first guide groove 57 such that the body part 107*b* protruding from the guided rod 101 contacts the left side wall 52. At this time, the protruding body part 107*b* is pushed to the spring holder 106 by the left side wall 52, the ring parts 107*a* contact the right wall 106*b* of the spring holder 106, and the ring parts 107*a* move away from each other along the right wall 106*b*. That is, the body part 107*b* is elastically deformed in a direction in which the curve is expanded.

The body part 107*b* of the wire spring 107 tends to be elastically recovered, and tends to protrude in the sheet transport direction being an example of a direction intersecting with the sheet width direction and extending along the stack surface 7*a*. The wire spring 107 urges the left side wall 52 and the guided rod 101 in a direction in which the left side wall 52 and the guided rod 101 are separated from each other, and the wire spring 107 urges the guided rod 101 toward the right side wall 51. Accordingly, in FIG. 9, the contact portions 103 and 104 at the right surface of the guided rod 101 are held while contacting the right side wall 51.

If a force in the sheet transport direction acts on the guided rod 101, the body part 107*b* is elastically deformed while the ring parts 107*a* slide along the right wall 106*b*. The force in the sheet transport direction is easily absorbed.

In the first exemplary embodiment, a reference urging force of the wire spring 107 when the guided rod 101 is fitted to the first guide groove 57 is determined as 0.2 [N].

Description for Spring Support Portion 111+112 to 117+112, and Coil Spring 121

Figure 16A:
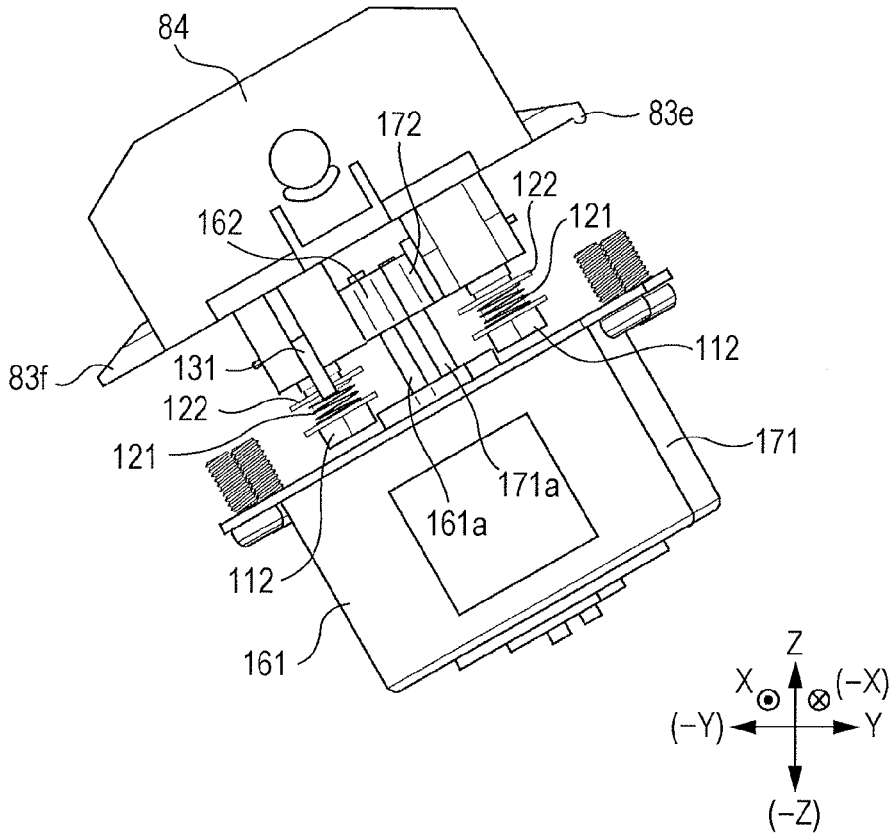
FIGS. 16A and 16B are views along arrow XVI in FIG. 12, FIG. 16A being an entire view, FIG. 16B being a partial enlarge view.
Figure 16B:
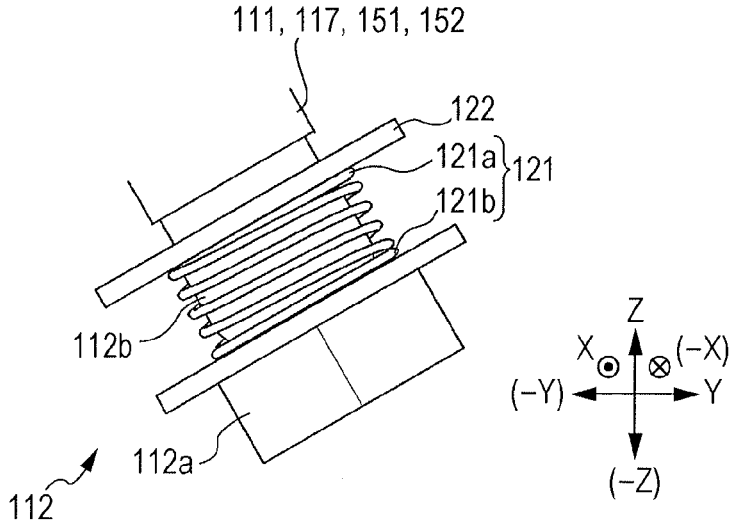

FIGS. 16A and 16B are views along arrow XVI in FIG. 12, FIG. 16A being an entire view, FIG. 16B being a partial enlarge view.

In FIG. 13, a pair of screw fixing portions 111 each being an example of a fixing portion is formed at the lower surface of the guided rod 101. The screw fixing portions 111 are formed at outer positions in the front-rear direction of the spring holders 106.

In FIGS. 10, 13, 16A, and 16B, the screw fixing portions 111 are formed into cylindrical shapes protruding to an obliquely lower right side from the guided rod 101, and have screw holes 111*a* each being an example of a fixing hole. In FIG. 10, when the guided rod 101 is fitted to the first guide groove 57, each screw fixing portion 111 is arranged in a state in which the screw fixing portion 111 enters the penetrating portion 53*a* of the bottom portion 53.

In FIGS. 10, 13, 16A, and 16B, a shoulder screw 112 being an example of a support member is supported at the screw hole 111*a* of the screw fixing portion 111.

In FIG. 10, the shoulder screw 112 includes a head part 112*a*, a column part 112*b*, and a screw part 112*c*. The column part 112*b* extends from the head part 112*a* to an upper left side and has no screw thread. The screw part 112*c* extends from the column part 112*b* to an upper left side and has a screw thread. The screw part 112*c* is screwed to the screw hole 111*a*.

In FIGS. 9 and 10, regarding the shoulder screw 112 according to the first exemplary embodiment, the screw part 112*c* is fixed to the screw fixing portion 111 from the lower side of the compile-tray body 7 in a state in which the stack plate 83 is supported at the upper side of the compile tray body 7. Hence, the head part 112*a* and the column part 112*b* of the shoulder screw 112 are arranged at a side opposite to the stack plate 83 with the compile-tray body 7 interposed therebetween. When the front tamper 81 moves in the front-rear direction, the shoulder screws 112 move along the penetrating portion 53*a* while protruding to the lower side of the compile-tray body 7.

The screw fixing portions 111 of the guided rod 101, and the shoulder screws 112 form a guided-rod spring support portion 111+112 being an example of one first-side support portion according to the first exemplary embodiment.

In FIGS. 12 and 13, a guided portion 116 being an example of one second-side guided portion is formed at the front-tamper body 92. The guided portion 116 protrudes from the lower surface of the stack plate 83 to correspond to the second guide groove 60. The guided portion 116 is formed at a position in the front-rear direction to correspond to the position of a guided-rod spring support portion 111+112 at the front side. The guided portion 116 is smaller than the width of the second guide groove 60, i.e., smaller than the gap between the left and right side walls 61 and 62. Hence, if the guided portion 116 is fitted to the second guide groove 60, the guided portion 116 is fitted to the second guide groove 60 with a play. Accordingly, the guided portion 116 is guided movably along the second guide groove 60.

In FIGS. 13, 16A, and 16B, a screw fixing portion 117 is formed at a lower surface of the guided portion 116. The screw fixing portion 117 is formed similarly to the screw fixing portion 111 of the guided rod 101. The screw fixing portion 117 is similar to the screw fixing portion 111 of the guided rod 101 except that, if the guided portion 116 is fitted to the second guide groove 60, the screw fixing portion 117 enters the penetrating portion 63*a* of the bottom portion 63. A shoulder screw 112 similar to the above-described shoulder screw 112 is supported at the screw fixing portion 117.

The screw fixing portion 117 of the guided portion 116 and the shoulder screw 112 form a guided-portion spring support portion 117+112 being an example of one second-side support portion according to the first exemplary embodiment.

The pair of front and rear guided-rod spring support portions 111+112 and the guided-portion spring support portion 117+112 form a three-point spring support portion 111+112 to 117+112 being an example of one three-point support portion according to the first exemplary embodiment.

In FIGS. 10, 16A, and 16B, the spring support portions 111+112 and 117+112 support coil springs 121 each being an example of an urging member that urges the front-tamper body 92 to the stack surface 7*a*.

Each coil spring 121 is mounted on the column part 112*b* of the shoulder screw 112. Also, a disk-shaped hollow flat washer 122 is mounted between the coil spring 121 and the compile-tray body 7 such that the column part 112*b* penetrates through the center of the flat washer 122. The flat washer 122 is an example of a friction reducing member. The flat washer 122 is supported so as to contact the lower surface of the compile-tray body 7 and so as to move in the front-rear direction along the lower surface of the compile-tray body 7.

The coil spring 121 is supported by the shoulder screw 112 in a compressed and elastically deformed manner. The coil spring 121 is held such that an upper left end 121*a* being an example of one end of the coil spring 121 indirectly contacts the lower surface of the compile-tray body 7 through the flat washer 122, and a lower right end 121*b* being an example of another end contacts the head part 112*a* of the shoulder screw 112. Hence, an elastic force with a predetermined strength acts on the coil spring 121.

The spring support portions 111+112 to 117+112 and the compile-tray body 7 are urged to be separated from each other by the elastic force of the coil springs 121. At this time, each shoulder screw 112 is urged to the lower right side, and the front-tamper body 92 to which the shoulder screw 121 is fixed is urged to the stack surface 7*a*. Accordingly, the lower surface of the stack plate 83 is held while contacting the stack surface 7*a*.

In the first exemplary embodiment, a pair of ribs 83*e* and 83*f*, each being an example of a bulging portion extending in the front-rear direction and bulging to a lower right side, is formed at both left and right ends of the lower surface of the stack plate 83. The ribs 83*e* and 83*f* are held while contacting the stack surface 7*a*.

Description for Light-Shielding Plate 131

In FIGS. 12, 13, 16A, and 16B, a plate-shaped light-shielding plate 131 being an example of one detected portion is supported at a front portion of the guided rod 101. The light-shielding plate 131 extends in the front-rear direction and extends to a lower right side. The light-shielding plate 131 moves inside the first guide groove 57, and may enter an area between the light-emitting portion 71*a* and the light-receiving portion 71*b* of the front sensor 71.

Hence, when the front tamper 81 moves forward, the light-shielding plate 131 is detected by the front sensor 71, and a home position being an example of an initial position of the front tamper 81 is detected.

The front-tamper body 92, the guided rod 101, the wire spring 107, the screw fixing portions 111 and 117, the guided portion 116, the shoulder screws 112, the coil springs 121, the flat washers 122, the light-shielding plate 131, etc., form the front tamper 81 being an example of a first alignment portion according to the first exemplary embodiment.

Description for Rear Tamper 82

In FIGS. 7 and 13, the rear tamper 82 is point-symmetric to the front tamper 81 with reference to a center portion in the front-rear direction except that a light-shielding plate 154 corresponding to the light-shielding plate 131 of the front tamper 81 is supported at a rear end of a guided portion 149 and moves inside the first guide groove 57.

In particular, the rear tamper 82 includes a stack plate 141, a rear contact portion 142, a guided rod 143, a rack tooth 144, contact portions 146 and 147, spring holders 148, a guided portion 149, screw fixing portions 151 of the guided rod 143, and screw fixing portions 152 of the guided portion 149 respectively corresponding to the stack plate 83, the front contact portion 86, the guided rod 101, the rack tooth 102, the contact portions 103 and 104, the spring holders 106, the guided portion 116, the screw fixing portions 111 of the guided rod 101, and the screw fixing portion 117 of the guided portion 116 of the front tamper 81.

The rear contact portion 142 being an example of another contact portion contacts another-side edges in the width direction of the recording sheets S stacked on the stack surface 7*a* and the stack plate 141, i.e., contacts rear edges of the recording sheets S. Also, the guided rod 143 being an example of another guided portion is guided movably along the second guide groove 60 in a state in which the guided rod 143 is fitted to the second guide groove 60. Further, the guided portion 149 being an example of another first-side guided portion is guided movably along the first guide groove 57 in a state in which the guided portion 149 is fitted to the first guide groove 57.

Accordingly, the stack plate 141, the rear contact portion 142, etc., form a rear-tamper body 153 being an example of a second alignment-portion body according to the first exemplary embodiment. The screw fixing portions 151 of the guided rod 143 and the shoulder screws 112 form a guided-rod spring support portion 151+112 being an example of another second-side support portion according to the first exemplary embodiment. The screw fixing portions 152 of the guided portion 149, and the shoulder screw 112 form a guided-portion spring support portion 152+112 being an example of another first-side support portion according to the first exemplary embodiment.

Description for Front Motor 161

Figure 17A:
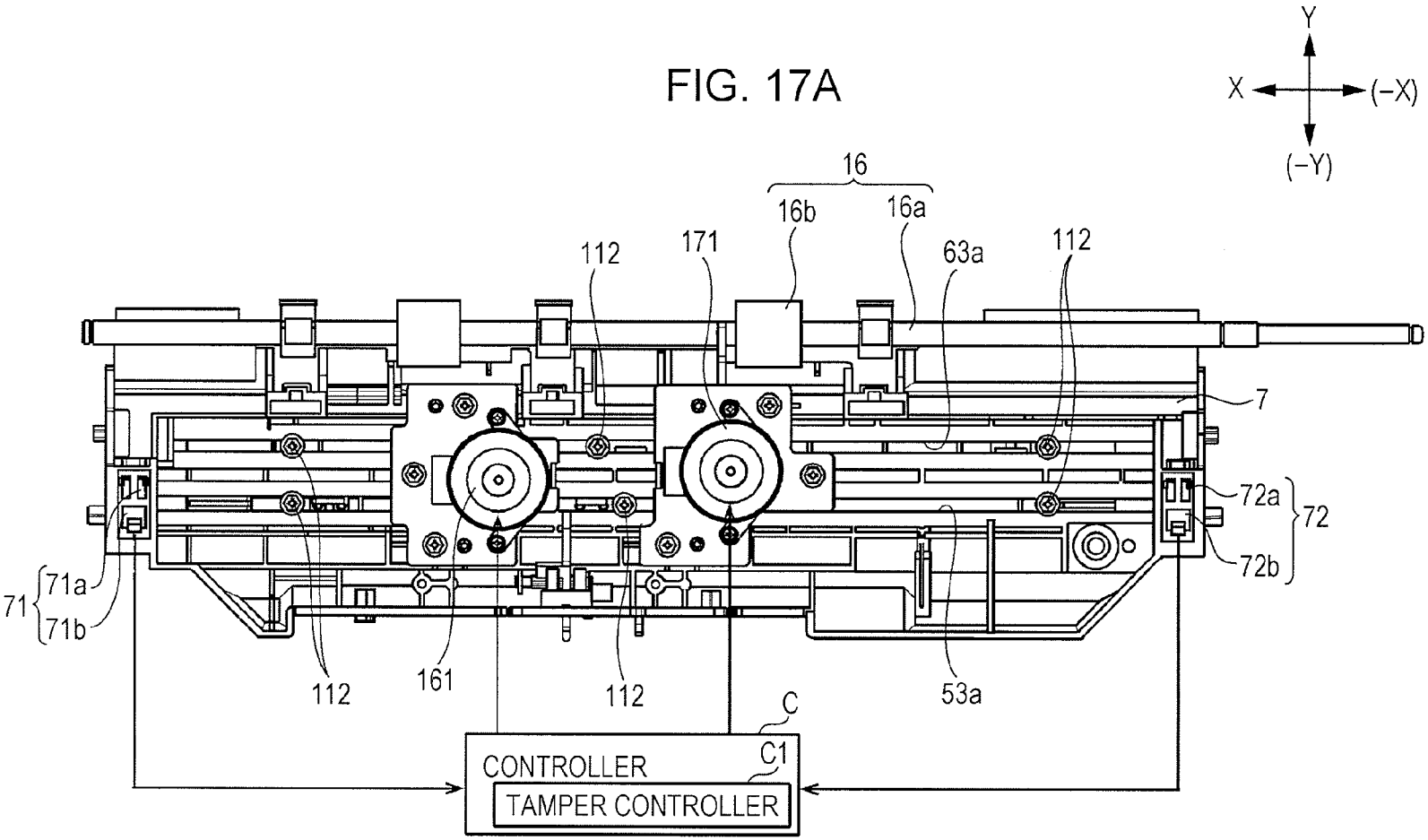
FIGS. 17A and 17B are explanatory views when the compile tray unit according to the first exemplary embodiment of the present invention is viewed from the lower side, FIG. 17A being an explanatory view when the tamper motor is supported by the compile tray, FIG. 17B being an explanatory view when the tamper motor is removed from the compile tray.
Figure 17B:
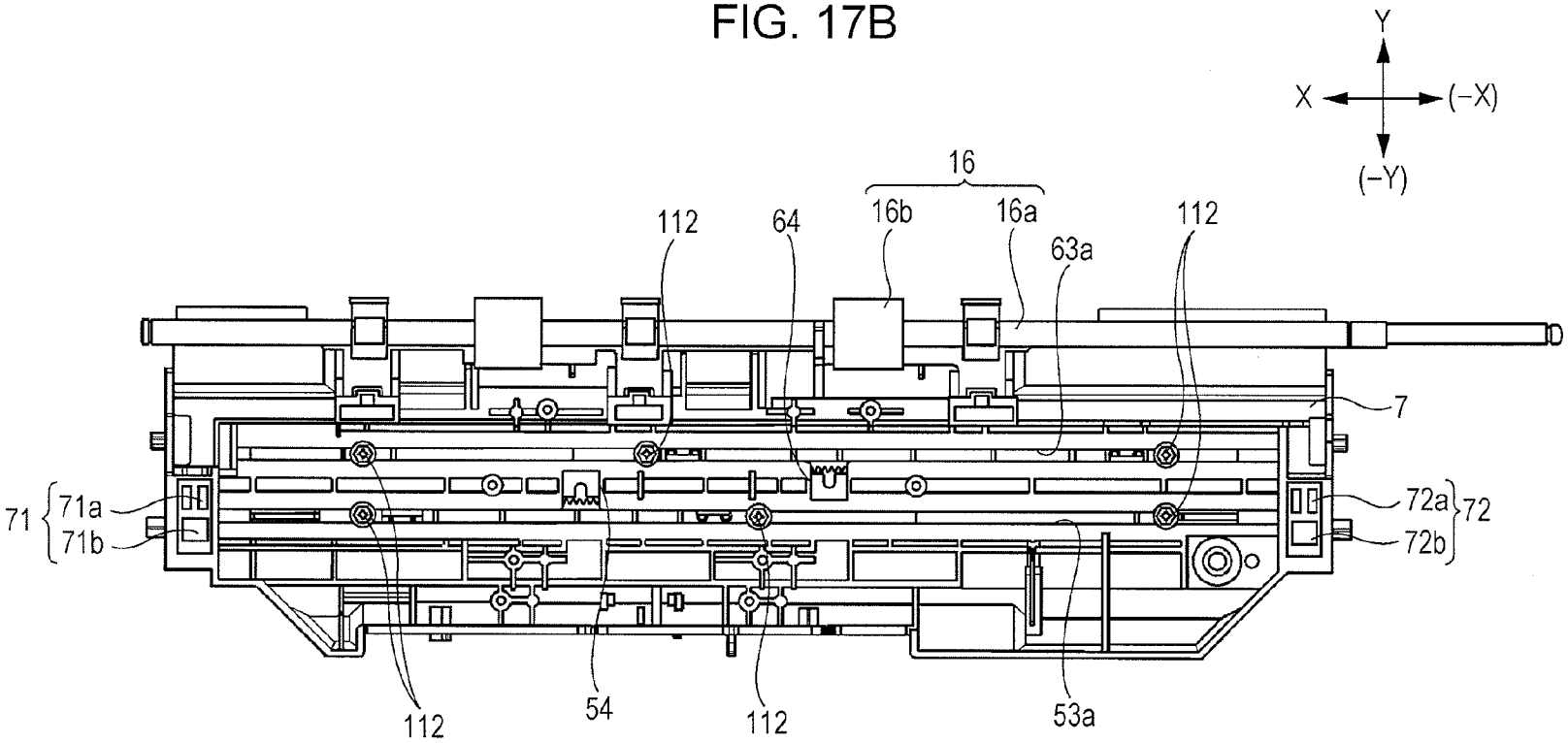

FIGS. 17A and 17B are explanatory views when the compile tray unit according to the first exemplary embodiment of the present invention is viewed from the lower side, FIG. 17A being an explanatory view when the tamper motor is supported by the compile tray, FIG. 17B being an explanatory view when the tamper motor is removed from the compile tray.

In FIGS. 8, 16A, 16B, 17A, and 17B, a front motor 161 being an example of a power source for the first alignment portion is supported below the compile-tray body 7. The front motor 161 includes a drive shaft 161*a*. In FIGS. 9 and 17B, a distal end of the drive shaft 161*a* is arranged at a position corresponding to the pinion opening 54 of the first guide groove 57. A pinion gear 162 being an example of a transmission member is supported at the distal end of the drive shaft 161*a*.

In FIGS. 9, 16A, and 16B, the pinion gear 162 is arranged in a state in which the pinion gear 162 enters the first guide groove 57 through the pinion opening 54. Hence, the pinion gear 162 is arranged in a protruding manner to a lower left side with respect to the right side wall 51, and meshes with the rack tooth 102 of the guided rod 101.

In FIG. 13, the rack tooth 102 is formed to correspond to a gravity-center position PG1 of the front tamper. A meshing position P1 being an example of a position at which the rack tooth 102 contacts the pinion gear 162 is determined to correspond to the gravity-center position PG1 of the front tamper 81 in the sheet transport direction. According to the first exemplary embodiment, as shown in FIG. 13, the meshing position P1 is determined to be superposed on an imaginary line L1 that extends in the front-rear direction and passes through the gravity-center position PG1 of the front tamper 81 in an imaginary two-dimensional plane parallel to the stack surface 7*a*. Hence, even if the front tamper 81 moves in the front-rear direction, the meshing position P1 is held to be superposed on the imaginary line L1.

As shown in FIG. 9, at the first guide groove 57, the protrusion 56 is arranged to correspond to the pinion opening 54. The protrusion 56 pushes a left surface portion of the guided rod 101 corresponding to the meshing position P1 to restrict rattling. Hence, even if the guided rod 101 is going to be separated from the pinion gear 162, the guided rod 101 is restricted by the protrusion 56. The meshing state between the rack tooth 102 and the pinion gear 162 is likely stable at the meshing position P1.

The front motor 161 according to the first exemplary embodiment is formed of a stepping motor, and is able to provide driving in normal and reverse directions. If the front motor 161 provides normal driving and hence the pinion gear 162 normally rotates, the rack tooth 102 receives a rearward force from the pinion gear 162, and the front tamper 81 moves rearward. If the front motor 161 provides reverse driving and hence the pinion gear 162 reversely rotates, the rack tooth 102 receives a forward force from the pinion gear 162, and the front tamper 81 moves forward.

Accordingly, the front tamper 81 is movable between an alignment position at which the front tamper 81 contacts the recording sheets S stacked on the stack surface 7*a* and aligns the positions of the recording sheets S, and a retraction position at which the front tamper 81 moves to the front side with respect to the alignment position and is retracted in a direction to be separated from the recording sheets S.

Description for Rear Motor 171

In FIGS. 8, 12, 17A, and 17B, a rear motor 171 being an example of a power source for a second alignment portion is supported at the rear side of the front motor 161. The rear motor 171 is similar to the front motor 161 except that the rear motor 171 transmits a drive force to the rear tamper 82.

In particular, in FIGS. 9, 13, 16A, 16B, and 17B, a pinion gear 172 corresponding to the pinion gear 162 is supported at a distal end of a drive shaft 171*a* of the rear motor 171, the pinion gear 172 meshes with the rack tooth 144 of the guided rod 143 at a meshing position P2, and the meshing position P2 is determined so as to be superposed on an imaginary line L2 that extends in the front-rear direction and passes through a gravity-center position PG2 of the rear tamper 82. Also, the rear tamper 82 is movable between an alignment position at which the rear tamper 82 contacts the recording sheets S stacked on the stack surface 7*a* and aligns the positions of the recording sheets S and a retraction position at which the rear tamper 82 moves to the rear side with respect to the alignment position and is retracted in a direction to be separated from the recording sheets S.

Description for Tamper Controller C1

In FIG. 17A, the controller C of the printer U1 includes a tamper controller C1 being an example of an alignment-member controller. The tamper controller C1 controls normal and reverse driving of the motors 161 and 171, and moves the tampers 81 and 82 between the alignment positions and the retraction positions.

In the first exemplary embodiment, home positions of the tampers 81 and 82 are determined at the retraction positions. Also, the alignment positions are previously determined based on the length in the width direction of the recording sheets S. The numbers of rotations of motors 161 and 171 from the retraction positions to the alignment positions are stored as reference values respectively for the tampers 81 and 82. Based on the reference values, the tamper controller C1 according to the first exemplary embodiment moves the tampers 81 and 82 between the retraction positions and the alignment positions every time when recording sheets S are stacked on the compile tray 6, aligns positions of front and rear edges of the bundle of a predetermined number of recording sheets S, and thus performs alignment.

The tamper controller C1 according to the first exemplary embodiment moves the tampers 81 and 82 synchronously in the same direction, entirely shifts the aligned bundle of recording sheets S in the front-rear direction, and thus performs off-setting.

Accordingly, in the first exemplary embodiment, before binding processing by the stapler 13*a*, the bundle of recording sheets S is off-set to a position that is previously determined based on the length in the width direction of the recording sheets S and based on the binding position of the recording sheets S, and performs any of "front-edge corner binding," "side-edge binding," and "rear-edge corner binding". Also, when the recording sheets S are output, bundles of recording sheets S are off-set, and are output to the stacker tray TH1 in an alternately shifted manner.

Operation of First Exemplary Embodiment

In the printer U according to the first exemplary embodiment having the above-described configuration, when a job being an example of an image formation operation is started, the printer body U1 forms images on recording sheets S, and the recording sheets S are transported from the printer body U1 to the post-processing device U3. If an input for performing post-processing, such as stapling and off-set outputting, is set, the recording sheets S transported to the post-processing device U3 are taken into the compile tray 6 by the paddles 11 and 23, post-processing, such as alignment, off-setting, and stapling, is performed, and the recording sheets S are output to the stacker tray TH1. If an input for performing post-processing is not set, the recording sheets S transported to the post-processing device U3 are not taken into the compile tray 6 and are output to the stacker tray TH1.

If alignment and stapling are performed, every time when a recording sheet S is transported to the compile tray 6, the front motor 161 and the rear motor 171 are driven, the front tamper 81 and the rear tamper 82 move in the front-rear direction, and hence the positions of the recording sheets S in the front-rear direction are aligned. In particular, the pinion gears 162 and 172 apply forces to the rack teeth 102 and 144, the guided rods 101 and 143 and the guided portions 116 and 152 are guided and move along the guide grooves 57 and 60, and the contact portions 86 and 142 of the tampers 81 and 82 contact edges of the recording sheets S.

At this time, the guided rods 101 and 143 are urged by the wire springs 107 in directions intersecting with the moving directions. The contact portions 103, 104, 146, and 147 of the guided rods 101 and 143 are guided while contacting the side walls 51 and 61. Also, the guided rods 101 and 143 and the guided portions 116 and 152 are urged by the coil springs 121 to a lower right side and hence are urged in a direction intersecting with the stack surface 7*a*. The guided rods 101 and 143 and the guided portions 116 and 152 are guided while the tamper bodies 92 and 153 contact the stack surface 7*a*.

In a typical configuration in which a guide portion guides a guided portion, a certain gap is previously provided between the guide portion and the guided portion, to prevent occurrence of a phenomenon in which the guided portion closely contacts the guide portion due to a manufacturing error or an assembly error and the guided portion no longer moves. That is, in the typical configuration in which the guide portion guides the guided portion, the guided portion has a play with respect to the guide portion. Hence, the alignment member may rattle when a drive force is transmitted from a transmission member or when the alignment member contacts recording sheets S and receives a force from the recording sheets S. Rattling may cause a noise, such as a drive sound or a contact sound, to be generated.

Figure 18A:
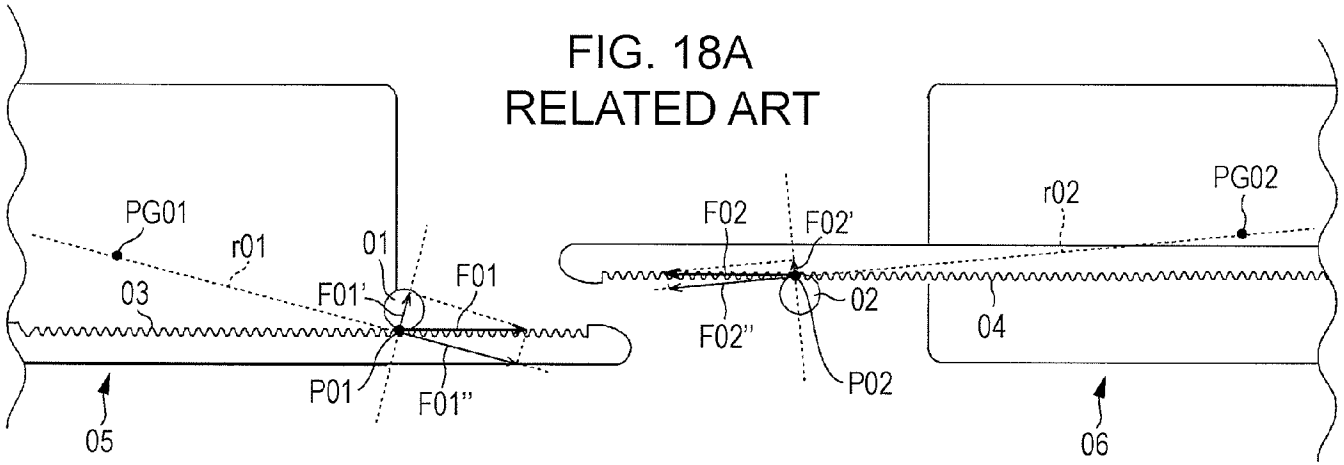
FIG. 18A RELATED ART
FIGS. 18A and 18B are explanatory views of actions of rotation moments acting on tampers from pinion gears, FIG. 18A being an explanatory view of related art when a meshing position does not correspond to the gravity-center position, FIG. 18B being an explanatory view of the first exemplary embodiment when a meshing position corresponds to the gravity-center position.
Figure 18B:
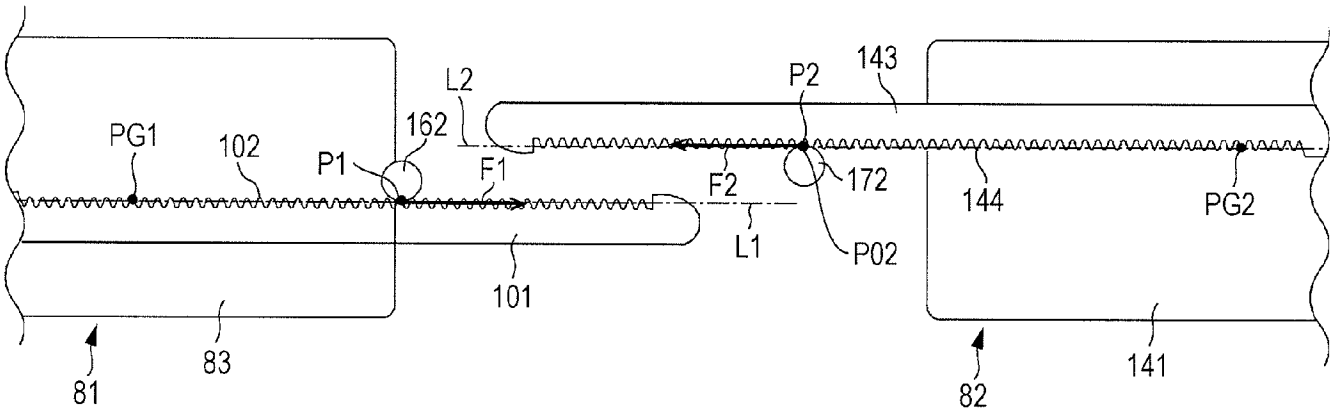

FIGS. 18A and 18B are explanatory views of actions of rotation moments acting on tampers from pinion gears, FIG. 18A being an explanatory view of related art when a meshing position does not correspond to the gravity-center position, FIG. 18B being an explanatory view of the first exemplary embodiment when a meshing position corresponds to the gravity-center position.

In FIG. 18A, with a configuration of related art, meshing positions P01 and P02 between pinion gears 01 and 02 and rack teeth 03 and 04 do not correspond to the gravity-center positions PG01 and PG02 of tampers 05 and 06, and the meshing positions P01 and P02 are separated from the gravity-center positions PG01 and PG02 in the sheet transport direction. Therefore, with the configuration of related art, imaginary lines r01 and r02 connecting the gravity-center positions PG01 and PG02 with the meshing positions P01 and P02 are inclined with respect to the front-rear direction being moving directions of the tampers 05 and 06.

If motors are driven and the pinion gears 01 and 02 rotate, the rack teeth 03 and 04 receive forces F01 and F02 in the front-rear direction along the moving directions from the pinion gears 01 and 02 at the meshing positions P01 and P02. Hence, the forces F01 and F02 act on the rack teeth 03 and 04 in a direction inclined with respect to the imaginary lines r01 and r02. Force components F01' and F02' in a direction perpendicular to the imaginary lines r01 and r02 and force components F01" and F02" in a direction along the imaginary lines r01 and r02 act on the tampers 05 and 06 through the rack teeth 03 and 04.

At this time, the force components F01' and F02' in the perpendicular direction act on the tamper 05 and 06 in a direction in which the tampers 05 and 06 rotate relative to the gravity-center positions PG01 and PG02. Rotary moments based on the forces F01 and F02 act on the tampers 05 and 06.

With the configuration of related art, when the tampers 05 and 06 receive the forces F01 and F02 from the pinion gears 01 and 02, the tampers 05 and 06 move in the front-rear direction and also are rotated and inclined. The guided rods 07 and 08 may contact side walls of guide grooves and a noise may be generated.

In contrast, according to the first exemplary embodiment, as shown in FIG. 18B, the meshing positions P1 and P2 are arranged to correspond to the gravity-center positions PG1 and PG2 of the tampers 81 and 82. The meshing positions P1 and P2 are arranged to be superposed on the imaginary lines L1 and L2 passing through the gravity-center positions PG1 and PG2 and extending in the front-rear direction. At the meshing positions P1 and P2, if the rack teeth 102 and 144 receive forces F1 and F2 in the front-rear direction from the pinion gears 162 and 172, the forces F1 and F2 act along the imaginary lines L1 and L2 regardless of the movement positions of the tampers 81 and 82. Hence, according to the first exemplary embodiment, force components in a direction perpendicular to the imaginary lines L1 and L2 are hardly generated from the forces F1 and F2. Rotation moments based on the forces F1 and F2 hardly act. According to the first exemplary embodiment, as compared with the configuration of related art in which the meshing positions do not correspond to the gravity-center positions of the tampers, the rotation is hardly made. Rattling and generation of a noise, such as a vibration sound or a contact sound are reduced.

Figure 19:
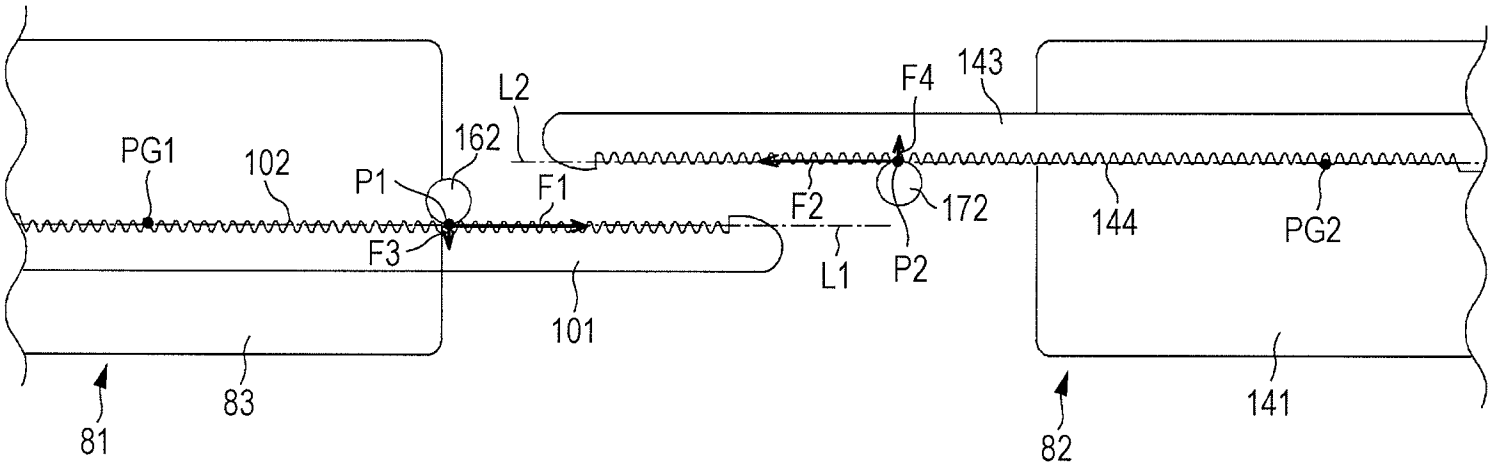
FIG. 19 is an explanatory view when a force that causes a rack tooth to be separated from the pinion gear acts on the rack tooth.

FIG. 19 is an explanatory view when a force that causes a rack tooth to be separated from the pinion gear acts on the rack tooth.

Also, according to the first exemplary embodiment, the protrusions 56 and 66 are arranged to correspond to the meshing positions P1 and P2. The protrusions 56 and 66 push the guided rods 101 and 143 toward the pinion gears 162 and 172 to restrict rattling.

In this case, the gravity-center positions PG1 and PG2 may be deviated from the meshing positions P1 and P2 due to a manufacturing error or an assembly error. The forces F1 and F2 in the front-rear direction may generate rotation moments, and the guided rods 101 and 143 may tend to be separated from the pinion gears 162 and 172. Also, forces in directions in which the rack teeth 102 and 144 are inclined with respect to the front-rear direction may act on the rack teeth 102 and 144 from the pinion gears 162 and 172 at the meshing positions P1 and P2 due to a manufacturing error, an assembly error, or the tooth shape. Hence, as shown in FIG. 19, forces F3 and F4 in which the rack teeth 102 and 144 become separated from the pinion gears 162 and 172 may act on the rack teeth 102 and 144 in addition to the forces F1 and F2 in the front-rear direction. The tampers 81 and 82 may tend to be separated from the pinion gears 162 and 172.

At this time, in the first exemplary embodiment, as shown in FIG. 9, the guided rods 101 and 143 contact the protrusions 56 and 66. Even if the forces F3 and F4 act in the direction in which the rack teeth 102 and 144 become separated from the pinion gears 162 and 172, since the guided rods 101 and 143 are supported by the protrusions 56 and 66, the guided rods 101 and 143 are prevented from being separated from the pinion gears 162 and 172. Hence, the meshing state between the pinion gears 162 and 172 and the rack teeth 102 and 144 hardly varies. Defective transmission of drive forces from the pinion gears 162 and 172 to the rack teeth 102 and 144 and wear due to galling are reduced. Therefore, according to the first exemplary embodiment, the life of the pinion gears 162 and 172 and the life of the rack teeth 102 and 144 are prevented from being reduced, and generation of a noise is reduced.

Also, in the first exemplary embodiment, the guided rods 101 and 143 are urged by the wire springs 107 in directions intersecting with the moving directions. The contact portions 103, 104, 146, and 147 of the guided rods 101 and 143 are guided in the front-rear direction while contacting the side walls 51 and 61.

Accordingly, the guided rods 101 and 143 are hardly inclined with respect to the guide grooves 57 and 60. As compared with a case without the wire springs 107, rattling of the tampers 81 and 82 hardly occurs and movement of the tampers 81 and 82 likely become stable. Generation of a noise, such as a vibration sound or a contact sound, is reduced.

Also, in the image-forming-apparatus body U1 and the post-processing device U3, even if vibration is generated because of movement of the tampers 81 and 82 or driving of the drive sources, the body part 107*b* of the wire spring 107 is elastically deformed and easily absorbs the vibration. Occurrence of rattling of the tampers 81 and 82 and generation of a noise are reduced.

In particular, according to the first exemplary embodiment, the wire springs 107 formed of wire members contact the side walls 52 and 62 of the guide grooves 57 and 60 and urge the guided rods 101 and 143.

If the urging member is not formed of the wire member, for example, if an urging member with a large width, such as a leaf spring that extends in the front-rear direction and is supported in a cantilevered manner is used in a configuration, the contact area between the urging member and each of the side walls 52 and 62 may become large. When the tampers 81 and 82 move in the front-rear direction, frictional resistance may become large.

In contrast, according to the first exemplary embodiment, the wire springs 107 are supported at the guided rods 101 and 143, and the curved linear body parts 107*b* extending in the front-rear direction or the moving directions contact the side walls 52 and 62. Hence, according to the first exemplary embodiment, the contact area with respect to the side walls 52 and 62 likely become small, and possibility of an increase in frictional resistance is reduced. At this time, according to the first exemplary embodiment, the body parts 107*b*, which are curved and rounded, contact the side walls 52 and 62. As compared with a case in which body portions are not rounded and contact the side walls 52 and 62, a frictional resistance during movement is reduced.

Also, if large-width urging members are used instead of the wire springs 107 according to the first exemplary embodiment, when the urging members are supported at the guided rods 101 and 143, the slits 106*f* and housing spaces 106*a* become large, and the strength of the guided rods 101 and 143 may be decreased. Also, if the strength of the guided rods 101 and 143 is increased, the guided rods 101 and 143 become large, and the compile tray unit CU becomes large.

Also, if the large-width urging members are supported at the outer surfaces of the guided rods 101 and 143 without using the slits 106*f*, certain gaps between the guided rods 101 and 143 and the guide grooves 57 and 60 have to be provided depending on the urging members at the outer surfaces. Thus, the compile tray unit CU becomes likely large.

In contrast, according to the first exemplary embodiment, the urging members in the direction intersecting with the moving directions are formed of the wire springs 107, and the spring holders 106 and 148 for supporting the wire springs 107 are formed at the guided rods 101 and 143.

In particular, according to the first exemplary embodiment, the wire springs 107 are supported such that the body parts 107*b* protrude from the housing spaces 106*a* of the spring holders 106 and 148 to the outside through the slits 106*f* with small slit widths while the ring parts 107*a* of the wire springs 107 are housed in the housing spaces 106*a*.

Accordingly, in the first exemplary embodiment, the urging members are supported while the thicknesses of the guided rods 101 and 143 are not excessively decreased. As compared with a case in which large-width urging members are supported, the strength of the guided rods 101 and 143 is likely ensured, and an increase in size of the compile tray unit CU is reduced.

Also, with the wire springs 107 of the first exemplary embodiment, the ring parts 107*a* are supported movably along the walls 106*b* of the spring holders 106 and 148. When vibration is transmitted to the tampers 81 and 82, the ring parts 107*a* move along the walls 106*b* of the ring parts 107*a* while the body parts 107*b* are elastically deformed. Thus, vibration is absorbed.

The vibration transmitted to the tampers 81 and 82 may become occasionally large due to disturbance or resonance. At this time, if the ring parts 107*a* are fixed, the body parts 107*b* have to absorb the whole vibration. Metal fatigue or plastic deformation may occur at the body parts 107*b*. With the configuration in which the ring parts 107*a* are fixed, the wire springs 107 may be likely deteriorated with time, and the life may become likely short.

In contrast, according to the first exemplary embodiment, the vibration is absorbed not only by the elastic deformation of the body parts 107*b* but also movement of the ring parts 107*a*. A load on the body parts 107*b* is likely reduced, and the life of the wire springs 107 may become likely long as compared with the case in which the ring parts 107*a* are fixed.

In the first exemplary embodiment, as compared with the case in which the ring parts 107*a* are fixed and supported, it may not be necessary to support members while positioning the members, and hence the wire springs 107 may be easily supported.

Also, in the first exemplary embodiment, the ring parts 107*a* have the larger thickness than the width of the slits 106*f*. The slits 106*f* hold the ring parts 107*a* and prevent the ring parts 107*a* from being fallen. Further, in the first exemplary embodiment, the ring-shaped ring parts 107*a* move along the walls 106*b*. As compared with a case in which end parts of wire members not having ring parts are moved, a resistance is reduced and the wire members may be easily moved.

Also, the wire springs 107 according to the first exemplary embodiment are arranged at the tampers 81 and 82 to correspond to the pair of contact portions 103 and 104 and the pair of contact portions 146 and 147 provided at the front and rear sides of the guided rods 101 and 143. As shown in FIG. 13, the wire springs 107 are arranged at positions superposed on the stack plates 83 and 141 and positions not superposed on the stack plates 83 and 141.

If the contact portions 103 to 147 are not provided at the guided rods 101 and 143, when the wire springs 107 urge the guided rods 101 and 143, the movement of the guided rods 101 and 143 in the urging direction is not restricted, and hence the rack teeth 102 and 144 excessively mesh with the pinion gears 162 and 172. Thus, meshing failure may likely occur.

Also, even if the pairs of front and rear contact portions 103 to 147 are provided, unless the wire springs 107 are arranged to correspond to the contact portions 103 to 147, for example, in a case in which the wire springs 107 are arranged at positions separated from the contact portions 103 to 147, for example, at center portions in the front-rear direction of the guided rods 101 and 143 elongated in the front-rear direction, the portions of the guided rods 101 and 143 urged by the wire springs 107 may bend to the pinion gears 162 and 172 as compared with both front and rear end parts that are positioned by the contact portions 103 to 147. Hence, at the portions arranged with the wire springs 107, the rack teeth 102 and 144 may excessively mesh with the pinion gears 162 and 172. In particular, if a stack plate and guided rods are integrally formed, and if the wire springs 107 are arranged at positions at which the guided rods 101 and 143 are not superposed on the stack plate 83, the portions of the guided rods 101 and 143 not being superposed on the stack plate 83 may be decreased in strength and may more likely bend. A meshing failure may likely occur.

In contrast, the guided rods 101 and 143 according to the first exemplary embodiment are provided with the pairs of front and rear contact portions 103, 104, 146, and 147. The pairs of front and rear wire springs 107 are arranged to correspond to the contact portions 103 to 147. Even if the wire springs 107 urge the guided rods 101 and 143, the contact portions 103 to 147 contact the side walls 51 and 61 and are supported thereby. As the result, the guided rods 101 and 143 are positioned, and the guided rods 101 and 143 hardly bend. Hence, according to the first exemplary embodiment, occurrence of the phenomenon in which the rack teeth 102 and 144 excessively mesh with the pinion gears 162 and 172 is reduced, wear due to defective transmission or galling hardly occurs, a decrease in life is restricted, and rattling and generation of a noise are reduced.

Also, according to the first exemplary embodiment, the guided rods 101 and 143 and the guided portions 116 and 149 are guided by the guide grooves 57 and 60, and the tampers 81 and 82 move in the front-rear direction. Hence, as compared with a case in which the pair of guided rods 101 and 143 arranged along the moving directions of the tampers only provides guiding, the guided portions 116 and 117 arranged in the sheet transport direction intersecting with the moving directions provide guiding. As the result, movement in the front-rear direction of the tampers 81 and 82 may become likely stable.

In particular, with the tampers 81 and 82 according to the first exemplary embodiment, the gravity-center positions PG1 and PG2 are determined to correspond to the inner sides of the guided rods 101 and 143 and the guided portions 116 and 149 in the direction intersecting with the moving directions. The distances between the guided rods 101 and 143 or the guided portions 116 and 149, and the gravity-center positions PG1 and PG2 may hardly become large as compared with a case in which the gravity-center positions are not determined to correspond to the inner sides. Hence, rotation moments acting on the tampers 81 and 82 through the guided parts 101, 143, 116, and 149 hardly become large when the guided parts 101, 143, 116, and 149 are guided by the guide grooves 57 and 60. Hence, according to the first exemplary embodiment, the rotation moments are reduced so as not to excessively act as compared with a case in which the gravity-center positions PG1 and PG2 are not determined to correspond to the inner sides of the guided rods 101 and 143 and the guided portions 116 and 149. The movement of the tampers 81 and 82 in the front-rear direction becomes further likely stable.

In the first exemplary embodiment, the guided portion 116 of the front tamper 81 is guided by the guide groove 60 of the guided portion 149 of the rear tamper 82, and the guided portion 149 of the rear tamper 82 is guided by the guide groove 57 of the guided rod 101 of the front tamper 81. The guide grooves are used in a shared manner. Hence, as compared with a case in which grooves for the guided portions 116 and 149 are newly formed, the configuration is simplified and the cost for fabrication is likely reduced.

Further, according to the first exemplary embodiment, the spring support portions 111+112, 117+112, 151+112, and 152+112 are provided at the guided rods 101 and 143 and the guided portions 116 and 149. The coil springs 121 supported at the spring support portions 111+112 to 152+112 urge the stack plates 83 and 141 of the tampers 81 and 82 to the stack surface 7*a*.

Here, with a configuration in which the stack plates 83 and 141 are not urged to the stack surface 7*a*, when the tampers 81 and 82 move in the front-rear direction, the front portions or rear portions of the stack plates 83 and 141 may rotate in a direction in which the front and rear portions are lifted from the stack surface 7*a* and may rattle.

In contrast, according to the first exemplary embodiment, the coil springs 112 urge the stack plates 83 and 141 to the stack surface 7*a*, and the stack plates 83 and 141 are likely held while contacting the stack surface 7*a*. Hence, in the first exemplary embodiment, as compared with the case in which the stack plates 83 and 141 are not urged to the stack surface 7*a*, the tampers 81 and 82 are held while contacting the stack surface 7*a* and hence rattling hardly occurs. Generation of a noise, such as a vibration sound or a contact sound, is reduced.

In particular, according to the first exemplary embodiment, the spring support portions 111+112 to 152+112 are provided at three positions of each of the tampers 81 and 82, and form the three-point spring support portions 111+112 to 116+112, and 151+112 to 152+112. Each of the tampers 81 and 82 is urged at the three points. In addition, according to the first exemplary embodiment, the gravity-center positions PG1 and PG2 of the tampers 81 and 82 are determined inside imaginary triangles having vertexes of the three-point spring support portions 111+112 to 116+112, and 151+112 to 152+112. As compared with urging made by one or two points, or a case in which the gravity-center positions PG1 and PG2 are determined outside the imaginary triangles, the stack plates 83 and 141 hardly rotate in a direction in which the stack plates 83 and 141 are lifted from the stack surface 7*a*. Hence, rattling hardly occurs.

In the first exemplary embodiment, when the stack plates 83 and 141 are held while contacting the stack surface 7*a*, the left and right ribs 83*e*, 83*f*, 141*e*, and 141*f* contact the stack surface 7*a*, but the entire lower surfaces of the stack plates 83 and 141 do not contact the stack surface 7*a*. Hence, the contact area between the stack plates 83 and 141, and the stack surface 7*a* is small according to the first exemplary embodiment. When the tampers 81 and 82 move in the front-rear direction, the frictional resistance hardly increases. Hence, according to the first exemplary embodiment, as compared with the case in which the entire lower surfaces of the stack plates 83 and 141 contact the stack surface 7*a*, occurrence of a phenomenon in which rattling and a noise are generated because the stack plates 83 and 141 are caught by the stack surface 7*a* by friction during movement is likely reduced.

When vibration is transmitted to the tampers 81 and 82 from the image-forming-apparatus body U1, the coil springs 121 of the spring support portions 111+112 to 152+112 are also elastically deformed and absorb the vibration. At this time, the coil springs 121 are elastically deformed along the column parts 112*b* of the shoulder screws 112. As compared with a case in which coil springs are elastically deformed along the screw parts 112*c*, occurrence of a phenomenon in which the coil springs contact the screws and generate a noise is reduced.

Also, according to the first exemplary embodiment, the tampers 81 and 82 move in the front-rear direction, the front contact portion 86 of the front tamper 81 and the rear contact portion 142 of the rear tamper 82 contact the edges of the recording sheets S. Thus, the recording sheets S on the compile tray 6 are aligned.

With the tampers 81 and 82 according to the first exemplary embodiment, the urethane foams 88 are arranged between the contact portions 86 and 142, and the support walls 84 of the tampers 81 and 82. When the contact portions 86 and 142 contact the recording sheets S, the urethane foams 88 are elastically deformed, and the elastic deformation absorbs an impact when the contact portions 86 and 142 contact the recording sheets S. Accordingly, with the first exemplary embodiment, as compared with a case in which the urethane foams 88 are not arranged, generation of damage at the front and rear edges of the recording sheets S is reduced, and a noise such as an impact sound during contact is reduced with the simple configuration.

Alternatively, spiral wire members, i.e., springs may be used instead of the urethane foams 88, to absorb an impact. However, if the springs are used, expansion and contraction of the springs generated when the contact portions 86 and 142 come into contact with and are separated from the recording sheets S likely cause the spring to vibrate, contact parts around the spring, and generate a noise.

In contrast, according to the first exemplary embodiment, since the urethane foams 88 are used, even if vibration is generated, the vibration is easily attenuated and absorbed. A noise is likely reduced with the simple configuration.

In the first exemplary embodiment, the home positions of the tampers 81 and 82 are detected when the light-shielding plates 131 and 154 enter the areas between the light-emitting portions 71*a* and 72*a* and the light-receiving portions 71*b* and 72*b* of the sensors 71 and 72. With the configuration in which rattling is not reduced, the gaps between the light-emitting portions 71*a* and 72*a* and the light-receiving portions 71*b* and 72*b* have to be wide to deal with rattling of the light-shielding plates 131 and 154. In contrast, according to the first exemplary embodiment, rattling of the tampers 81 and 82 is reduced, and the gaps between the light-emitting portions 71*a* and 72*a* and the light-receiving portions 71*b* and 72*b* are likely narrowed. Thus, according to the first exemplary embodiment, the configurations of the sensors 71 and 72 are likely downsized, and the light-emitting portions 71*a* and 72*a* are close to the light-receiving portions 71*b* and 72*b*. As compared with a case in which the light-emitting portions 71*a* and 72*a* are separated from the light-receiving portions 71*b* and 72*b*, detection accuracy becomes likely stable.

Modifications

The exemplary embodiment of the present invention has been described above; however, the present invention is not limited to the exemplary embodiment, and may be modified within the scope of the present invention described in the claims. Modifications (H01) to (H021) of the invention are exemplarily described below.

(H01) In the above-described exemplary embodiment, the printer U is used as an example of an image forming apparatus. However, it is not limited thereto. The image forming apparatus may be a copier, a facsimile, or a multifunction apparatus including such plural functions. Also, the image forming apparatus is not limited to an image forming apparatus of electrophotographic system, and may be applied to an image forming apparatus, for example, a printer of any image formation system, such as inkjet recording system, thermal head system, and lithography system. Further, the image forming apparatus is not limited to an image forming apparatus of multiple-color development, and may be formed of an image forming apparatus of a single color, i.e., monochrome.

(H02) In the above-described embodiment, the compile tray unit CU of the post-processing device U3 is provided as an example of a medium transport device, and the configurations of the tampers 81 and 82 included in the compile tray unit CU are exemplarily described. However, it is not limited thereto. For example, the medium transport device may be a configuration of a paper feed tray or a transport path for recording sheets S. The tampers 81 and 82 may be provided at the paper feed tray, or the tampers 81 and 82 may be provided in the middle of the transport path, so that the positions in the width direction of the recording sheets S are aligned at the paper feed tray or in the middle of the transport path. If the tampers 81 and 82 are provided at the paper feed tray, the motors 161 and 171 may be omitted, and the tampers 81 and 82 may be manually moved.

(H03) In the above-described embodiment, the configuration is exemplarily described in which the guided rods 101 and 143 and the guided portions 116 and 149 being the examples of the guided portions are guided by the guide grooves 57 and 60 being the examples of the guide portions. However, it is not limited thereto. For example, as long as a configuration in which a guided portion is guided by a guide portion is employed, such as a configuration in which a shaft-shaped guide portion extending in the front-rear direction is provided at a stack portion and a ring-shaped guided portion is guided along the guide portion, any configuration of a guide portion and a guided portion may be employed.

(H04) In the above-described embodiment, the configuration is exemplarily described in which the drive forces are transmitted from the motors 161 and 171 to the tampers 81 and 82 by racks and pinions, configured such that the drive forces are transmitted from the pinion gears 162 and 172 being the examples of the transmission members to the rack teeth 102 and 144 being the examples of the transmitted portions. However, it is not limited thereto. For example, a configuration may be provided, the configuration including a belt-shaped transmission member being movable in the front-rear direction; a transmitted portion that is fixed to the transmission member, receives a force from the transmission member, and moves with the transmission member; and an alignment-member body that moves together with the transmitted portion.

(H05) In the above-described embodiment, the configuration is exemplarily described in which both the front tamper 81 and the rear tamper 82 move in the front-rear direction. However, a configuration may be provided in which one of the tampers is fixed and only the other tamper moves.

(H06) In the above-described embodiment, the meshing positions P1 and P2 between the pinion gears 162 and 172 and the rack teeth 102 and 144 are desirably superposed on the imaginary lines L1 and L2 passing through the gravity-center positions PG1 and PG2 and extending in the front-rear direction. However, it is not limited thereto. The meshing positions P1 and P2 may be set to correspond to the gravity-center positions PG1 and PG2, for example, by arranging the meshing positions P1 and P2 at positions close to the imaginary lines L1 and L2. The meshing positions P1 and P2 may be set at positions deviated from the imaginary lines L1 and L2.

(H07) In the above-described embodiment, the protrusions 56 and 66 are desirably arranged to correspond to the meshing positions P1 and P2. However, it is not limited thereto. For example, the protrusions 56 and 66 may be separated from the meshing positions P1 and P2 in the front-rear direction, or the protrusions may be omitted.

(H08) In the above-described embodiment, the wire springs 107 desirably urge the guided rods 101 and 143 in the sheet transport direction being an example of the direction intersecting with the moving directions. However, it is not limited thereto. For example, the wire springs extending in the front-rear direction may be supported in a cantilevered manner by the guided rods 101 and 143; urging members with a large width, such as leaf springs, may urge the guided rods 101 and 143; or urging members of a certain kind may urge the guided rods 101 and 143 in the sheet transport direction.

(H09) In the above-described embodiment, the wire springs 107 are arranged only at the guided rods 101 and 143. However, the wire springs 107 may be arranged at the guided portions 116 and 149. Also, the wire springs 107 are desirably arranged at the guided rods 101 and 143 because the meshing state between the pinion gears 162 and 172 and the rack teeth 102 and 144 is stable. However, the wire springs 107 may be arranged only at the guided portions 116 and 149.

The number of wire springs 107 arranged at the guided rods 101 and 143 is not limited to two for each of the tampers 81 and 82. The number of wire springs 107 may be one, or three or more.

(H010) In the above-described embodiment, the contact portions 103 to 147 are provided at the rack teeth 102 and 144 of the guided rods 101 and 143, and the wire springs 107 urge the guided rods 101 and 143 to the rack teeth 102 and 144 to bring the guided rods 101 and 143 into contact. However, it is not limited thereto. For example, the arrangement positions of the wire springs 107 and the contact portions 103 to 147 may be inverted, so that the wire springs 107 urge the guided rods 101 and 142 to cause the guided rods 101 and 142 to be separated from the pinion gears 162 and 172, and the contact portions 103 to 147 contact side walls of the guide grooves 57 and 60 for holding the contact portions 103 to 147.

(H011) In the above-described embodiment, the contact portions 103 to 147 are desirably provided at the guided rods 101 and 143 to correspond to the arrangement positions of the wire springs 107. However, the contact portions 103 and 147 may be provided at positions separated from the wire springs 107, or the contact portions 103 to 147 may be omitted.

(H012) In the above-described embodiment, the guided rod 101 of the tamper 81 shares the guide groove 57 with the guided portion 149 of the tamper 82, and the guided rod 143 of the tamper 82 shares the guided groove 60 with the guided portion 116 of the tamper 81. However, it is not limited thereto. Guide grooves may be provided individually for the guided rods 101 and 143 and the guided portions 116 and 149, so that the guided rods 101 and 143 and the guided portions 116 and 149 move along the individual guide grooves.

(H013) In the above-described embodiment, the guided rods 101 and 143 and the guided portions 116 and 149 are guided by the side walls 51, 52, 61, and 62 of the guide grooves 57 and 60, and the tampers 81 and 82 move in the front-rear direction. However, it is not limited thereto. The spring support portions 111+112 to 152+112 supported by the stack plates 83 and 141 may be guided by the guide grooves 57 and 60. For example, the column parts 112*b* of the shoulder screws 112 supported at the lower ends of the guided rods 101 and 143 and the guided portions 116 and 149 may be guided by the penetrating portions 53*a* and 63*a* of the guide grooves 57 and 60.

(H014) In the above-described embodiment, the guided portions 116 and 149 are desirably provided in addition to the guided rods 101 and 143. However, it is not limited thereto. The guided portions 116 and 149 may be omitted. In this case, as described in the modification (H014), the spring support portions 116+112 and 152+112 may be guided by the guide grooves 60 and 57, or the holes of the penetrating portions 53*a* and 63*a* may be expanded and the spring support portions 116+112 and 152+112 may not provide guiding but may only provide urging.

(H015) In the above-described embodiment, each of the tampers 81 and 82 is desirably urged by the coil springs 121 at the three positions. However, it is not limited thereto. Each of the tampers 81 and 82 may be urged at one, two, or four or more positions.

(H016) In the above-described embodiment, the spring support portions 111+112 to 152+112 are desirably provided at the guided rods 101 and 143 and the guided portions 116 and 149, and the coil springs 121 desirably urge the tamper bodies 92 and 153 to the stack surface 7*a* at the positions near the guided rods 101 and 143 and the guided portions 116 and 149. However, it is not limited thereto. In other words, a play is desirably provided between the guide portion and the guided portion, and urging is provided at positions near the guided rods 101 and 143 and the guided portions 116 and 149 where rattling occurs. However, the tamper bodies 92 and 153 may be urged at desirable positions depending on the design and configuration.

(H017) In the above-described embodiment, the coil springs 121 are supported in an elastically compressed manner, and the coil springs 121 that are going to be elastically recovered urge the tamper bodies 92 and 153 to the stack surface 7*a*. However, it is not limited thereto. For example, support portions that support tension springs may be provided instead of the spring support portions 111+112 to 152+112, and the flat washers 122 are pulled from the tamper bodies 92 and 153 through the penetrating portions 53*a* and 63*a*, so that the tamper bodies 92 and 153 are urged to the stack surface 7*a*. Thus, a desirable urging member may be used for urging, without limiting to the configuration of the first exemplary embodiment.

(H018) In the above-described embodiment, the guided rods 101 and 143 are urged because the wire springs 107 are elastically recovered in a direction in which the wire springs 107 push the side walls 52 and 62. However, it is not limited thereto. For example, support portions for tension springs may be provided at positions outside the contact portions 103 to 147 of the guided rods 101 and 143 in the front-rear direction, and penetrating grooves extending in the front-rear direction may be provided at the side walls 51 and 61 of the guide grooves 57 and 60. Hence, by pulling the guided rods 101 and 143 with the tension springs like the modification (H017), the guided rods 101 and 143 may be urged to the pinion gears 162 and 172.

(H019) In the above-described embodiment, the urging members that urge the guided rods 101 and 143 in the sheet transport direction, i.e., the wire springs 107 are supported by the guided rods 101 and 143. However, it is not limited thereto. For example, urging members may be arranged at the compile-tray body 7, and the guided rods 101 and 143 may move while the guided rods 101 and 143 contact the urging members and are guided by the urging members.

(H020) In the above-described embodiment, the wire springs 107 are desirably provided. However, the wire springs 107 may be omitted.

(H021) In the above-described embodiment, the coil spring 121 being an example of a first urging portion and the coil spring 121 being an example of a second urging portion are provided, and the similar coil springs 121 are supported at the spring support portions 111+112 to 152+112 of the tampers 81 and 82. However, it is not limited thereto. For example, if a rattling state of the one tamper 81 differs form a rattling state of the other tamper 82 because of a difference in arrangement positions, coil springs with different elastic forces may be used for the one tamper 81 and the other tamper 82. Alternatively, coil springs may be used respectively for the spring support portions 111+112 to 152+112.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is Claimed is:

1. A medium transport device, comprising:

a stack portion having a stack surface, a medium being stacked on the stack surface;

a guide portion provided at the stack surface, the guide portion extending in a width direction intersecting with a transport direction, the medium being transported in the transport direction;

an alignment member supported movably along the guide portion, the alignment member contacting the medium and aligning a position of the medium stacked on the stack surface; and an urging member arranged between the alignment member and the stack portion, the urging member urging the alignment member to the stack surface, wherein two portions of the urging member are abutted against the alignment member at two positions, and wherein the two portions at the two positions translate relative to each other in the width direction.

2. The medium transport device according to claim 1, comprising:

the guide portion having a groove shape penetrating through the stack portion in a direction intersecting with the stack surface;

the alignment member including an alignment-member body that contacts the medium and aligns the position of the medium stacked on the stack surface, a guided portion having one end part and another end part, the one end part being supported by the alignment-member body, the guided portion protruding in a direction in which the guided portion penetrates through the guide portion, the guided portion being guided movably along the guide portion, and a support portion provided at the other end part of the guided portion penetrating through the guide portion, the support portion supporting the urging member; and the urging member arranged between the support portion of the alignment member and the stack portion, the urging member urging the support portion and the stack portion in directions in which the support portion and the stack portion are separated from each other, the urging member urging the alignment-member body to the stack surface.

3. The medium transport device according to claim 2, comprising:

the guide portion including a first guide portion formed at the stack surface, the first guide portion having a groove shape penetrating through the stack portion in the direction intersecting with the stack surface and extending in the width direction, and a second guide portion formed in parallel to the first guide portion with a gap provided therebetween in the transport direction, the second guide portion having a groove shape penetrating through the stack portion in the direction intersecting with the stack surface and extending in the width direction;

the alignment member including a first alignment portion that aligns a position of one edge in the width direction of the medium stacked on the stack surface, and a second alignment portion that aligns a position of another edge in the width direction of the medium stacked on the stack surface, wherein the first alignment portion includes a first alignment-portion body that contacts the one edge of the medium stacked on the stack surface, one guided portion having one end part and another end part, the one end part being supported by the first alignment-member body, the one guided portion protruding in a direction in which the one guided portion penetrates through the first guide portion, the one guided portion being guided movably along the first guide portion, one first-side support portion provided at the other end of the one guided portion penetrating through the first guide portion, the one first-side support portion supporting the urging member, and one second-side support portion having one end part and another end part, the one end part being supported by the first alignment-portion body, the one second-side support portion protruding in a direction in which the one second-side support portion penetrates through the second guide portion, the other end part penetrating through the second guide portion supporting the urging member, and wherein the second alignment portion includes a second alignment-portion body that contacts the other edge of the medium stacked on the stack surface, another guided portion having one end part and another end part, the one end part being supported by the second alignment-portion body, the other guided portion protruding in a direction in which the other guided portion penetrates through the second guide portion, the other guided portion being guided movably along the second guide portion, another second-side support portion that is provided at the other end part of the other guided portion penetrating through the second guide portion, the other second-side support portion supporting the urging member, and another first-side support portion having one end part and another end part, the one end part being supported by the second alignment-portion body, the other first-side support portion protruding in a direction in which the other first-side support portion penetrates through the first guide portion, the other end part penetrating through the first guide portion supporting the urging member; and the urging member including a first urging portion arranged between each of the one first-side and second-side support portions and the stack portion, the first urging portion urging each of the one first-side and second-side support portions and the stack portion in a direction in which each of the support portions and the stack portion are separated from each other, the first urging portion urging the first alignment-portion body to the stack surface, and a second urging portion arranged between each of the other first-side and second-side support portions and the stack portion, the second urging portion urging each of the other first-side and second-side support portions and the stack portion in a direction in which each of the support portions and the stack portion are separated from each other, the second urging portion urging the second alignment-portion body to the stack surface.

4. The medium transport device according to claim 3, comprising:

the one second-side support portion that is guided movably along the second guide portion; and the other first-side support portion that is guided movably along the first guide portion.

5. post-processing device, comprising:

the medium transport device according to claim 1, a medium with an image recorded thereon being fed to the medium transport device; and an output portion, the medium transported by the medium transport device being output to the output portion.

6. An image forming apparatus, comprising:

an image recording unit that records an image on a medium;

the medium transport device according to claim 1, the medium with the image recorded thereon by the image recording unit being fed to the medium transport device; and an output portion, the medium transported by the medium transport device being output to the output portion.

7. The medium transport device according to claim 1, wherein the urging member urges in a direction intersecting with the stack surface.

* * * * *